United States Patent [19]

Morris

[11] Patent Number: 4,491,106

[45] Date of Patent: Jan. 1, 1985

[54] THROTTLE CONFIGURATION ACHIEVING HIGH VELOCITY CHANNEL AT PARTIAL OPENING

[76] Inventor: George Q. Morris, 655 Paseo Esmeralda, Newbury Park, Calif. 91320

[21] Appl. No.: 617,144

[22] Filed: Jun. 4, 1984

Related U.S. Application Data

[63] Continuation of Ser. No. 445,593, Nov. 29, 1982, abandoned, which is a continuation of Ser. No. 285,068, Jul. 20, 1981, abandoned.

[51] Int. Cl.[3] ..... F02D 9/08

[52] U.S. Cl. ..... 123/337; 123/336; 261/65

[58] Field of Search ..... 123/336, 337; 261/65

[56] References Cited

U.S. PATENT DOCUMENTS

| | | | |
|---|---|---|---|
| 2,801,088 | 7/1957 | Glenn | 261/65 |
| 3,943,904 | 3/1976 | Byrne | 123/336 |
| 4,256,066 | 3/1981 | Serruys | 261/65 |

*Primary Examiner*—William A. Cuchlinski, Jr.
*Attorney, Agent, or Firm*—Richard Slehofer

[57] ABSTRACT

A carburetion system for an internal combustion engine wherein the cooperation of throttle blades with the throttle body forms channels for high velocity fuel/air mixture flow at part throttle conditions. Fuel is introduced into air flowing through the main intake passage upstream of throttle blades. At partial throttle conditions, the fuel/air mixture flows substantially only through the channels. Fuel/air mixture emerges from the channels at high speed. The channels can be configured such that the emergent fuel/air mixture streams from the channels are directed on convergent paths. Converging streams from the channels collide in the air intake downstream from the throttles, where the severe turbulence resulting from the convergence causes liquid fuel to be finely atomized and evenly suspended in the intake air. Some of the liquid fuel from the mixture may separate onto the walls of the throttle body as a result of passage through the channels or turbulence from the region of convergence. The throttle body may be heated to assist in vaporizing separated liquid fuel.

1 Claim, 35 Drawing Figures

THROTTLE CONFIGURATION ACHIEVING HIGH VELOCITY CHANNEL AT PARTIAL OPENING

This application is a continuation of application Ser. No. 445,593, filed 11-29-82, now abandoned, which is a continuation of application Ser. No. 285,068, filed July 20, 1981, now abandoned.

BACKGROUND OF THE INVENTION

This invention relates to liquid fuel supply systems in general, and more particularly pertains to fuel/air mixing and modulating systems wherein butterfly type throttle blades cooperate with a throttle body at partial throttle openings to modulate the flow of fuel and air through an air inlet passageway.

It is well known in the art of liquid fuel supply to internal combustion engines that engine efficiency improves as more of the fuel is vaporized or atomized into smaller droplets and evenly homogenized into the fuel/air mixture. The present most commonly employed system for supplying fuel to an engine is with a carburetor which uses a butterfly type valve to regulate the fuel/air supply to the engine. The blades of the valve are typically thin and flat across their entire length, and configured to cooperate with the straight walls of the air intake passageway in which the throttle valve is located. This configuration results in fuel/air mixture flow characteristics around and downstream from the throttle blade or blades which effect the fuel/air mixture adversely with respect to vaporization or atomizing fuel into small droplets and evenly mixing it with the intake air.

In the conventional carburetor using butterfly throttle blades, partial throttle intake mixture flows essentially equally around both sides of the throttle blade. In this configuration, some liquid fuel tends to separate out of the mixture onto the intake passageway walls and throttle blades as the fuel/air mixture passes around the blade edges of the partially closed throttle. No provision is made for the separated fuel to re-enter the intake air for the formation of a homogenous fuel/air mixture. The separated fuel runs along the throttle blade and the walls of the engine intake passageways, and subsequently enters the cylinders in droplets that are too large for efficient combustion, resulting in reduced engine efficiency.

More recent designs have concentrated on the formation of high velocity airstreams through a convergent-divergent portion of the main intake passageway, usually constricted by a movable conical section which functions both as a throttle and a venturi forming device. These designs, when properly engineered, have excellent fuel atomizing and mixing characteristics. However, they have notorious difficulties with proper fuel metering for all engine operating conditions. Additionally, they are difficult and expensive to construct due to the general requirement for a large number of precision machined parts which cannot be constructed using existing carburetor manufacturing tooling and techniques.

The present invention discloses a carburetor throttle and throttle body assembly which can take advantage of fuel separation to achieve better fuel vaporization and atomization, but which avoids the unfavorable fuel separation problems of more conventional designs, yet achieves the partial throttle efficiency of the conical venturi designs without the adverse effects on fuel metering and without the extraordinary and expensive construction requirements.

According to the present invention there is provided a novel carburetor throttle assembly wherein butterfly type throttle blades have regions of cooperation with the throttle body such that channels are formed at partial throttle openings. As the throttle blades rotate open at partial throttle settings, the channels open much more quickly than other seal areas, so substantially all of the part throttle intake mixture flows through the channels. Due to the angles of the channels with respect to the main intake flow path, and due to the high velocity change effected by the channels, separation of liquid fuel onto the throttle body can be controlled or enhanced. The walls of the throttle body can be heated to enhance vaporization of the separated fuel. As convergent high speed fuel/air streams exiting the channels collide downstream from the throttles, liquid fuel is finely atomized and thoroughly mixed with the intake air.

The resulting improvement of fuel atomization and vaporization at partial throttle openings results in a corresponding improvement in engine efficiency at partial load conditions.

SUMMARY OF THE INVENTION

This invention relates in general to carburetors having butterfly type throttle valves, and more particularly pertains to a novel carburetor mixing and modulating throttle design wherein channels are formed at partial throttle openings at a region of cooperation between butterfly type throttle blades and surfaces of the throttle body. In passing through these channels, the fuel/air mixture undergoes a severe change in velocity. Fuel/air mixture flows through these channels at very high speeds, due to the large pressure difference that normally exists across the throttle at partial throttle openings.

In some embodiments of the invention, the channels can be configured such that the high speed fuel/air mixture streams exiting the channels collide centrally in the intake downstream from the throttles to form regions of severe turbulence which thoroughly atomize liquid fuel and evenly mix it into the intake air.

Also, in some embodiments of the invention, the nature of the severe velocity change owing to the presence of the channels causes some of the larger fuel droplets to separate out of the fuel/air mixture onto the walls of the throttle body. The separated liquid fuel then re-enters the emergent high speed mixture stream from the channels. In the process of re-entering the high speed mixture, the liquid fuel is thoroughly mixed into the emergent mixture streams from the channels. The walls of the throttle body can be heated to enhance vaporization of liquid fuel which separates out of the mixture onto those walls.

A particularly advantageous feature of the present invention is that the liquid fuel droplets are broken into smaller droplets in a two-stage process: large droplets in the intake passageway upstream of the throttle blades are broken into smaller droplets by the severe change in velocity that occurs as the droplets are accelerated into the high speed airstream at the entrance to the channels; then, the smaller droplets are further broken down by the severe turbulence that exists due to the effects of the channel flow streams downstream from the throttle blades.

At larger throttle openings, the channels become essentially indistinct from the main mixture passageway. Thus, the fuel/air mixture at large engine loads can flow through a larger area with less restriction, resulting in greater engine power. Also at larger engine loads, the deformation of the novel channels allows flow of the fuel/air mixture without enhanced separation of liquid fuel. Enhanced separation is not desirable when the pressure difference across the throttle is small, as at larger engine load conditions.

The cooperating surfaces of the throttle blades with the walls of the throttle body can be shaped to give many desirable cross sectional configurations to the novel channels. The channels may be straight-walled for manufacturing simplicity, may have a venturi shape for enhanced velocity characteristics, may be curved, or may be convergent or divergent for special flow effects.

Since the present invention concerns a throttle design utilizing butterfly type throttle valves, it is reasonably easy to construct with present techniques for manufacturing such equipment.

Accordingly, one object of the present invention is to provide a fuel/air mixing and modulating throttle design that is simple and lends itself well to conventional manufacturing techniques.

Another object is to provide a throttle design for a carburetor which forms channels between the throttle blades and cooperating walls of the throttle body in the intake passageway at partial throttle openings.

Another object is to provide a throttle design forming channels between the throttle blades and cooperating walls of the throttle body in the intake passageway wherein the fuel/air mixture flows at high speed at partial throttle openings.

Yet another object is to provide a throttle design wherein the flow of the fuel/air mixture is not severely restricted at more open positions of the throttle.

Another object is to provide a throttle design wherein cooperation between the throttle blades and the throttle body forms flow channels which can direct the fuel/air mixture flow in such a manner that enhanced liquid fuel separation from the fuel/air mixture occurs.

A still further object is to provide a mixing and modulating throttle design wherein channels formed between the throttle blades and cooperating walls of the throttle body cause enhanced liquid fuel separation onto the walls of the throttle body, and where the walls of the throttle body can be heated to enhance vaporization of the liquid fuel which separates onto those walls.

Another object is to provide a carburetor throttle design wherein separated liquid fuel re-enters high speed fuel/air streams which emerge from channels formed between throttle blades and cooperating surfaces of the throttle body, such that the re-entrant fuel is mixed into the streams.

Yet another object is to provide a carburetor throttle design wherein a plurality of throttle blades can form multiple channels at regions of cooperation with the walls of an extension of the throttle body located in the air intake passageway.

A still further object is to provide a throttle design for a carburetor body containing an air intake passageway, where a plurality of throttle blades forms multiple channels at regions of cooperation with walls of the air intake passageway, and where high speed fuel/air mixture streams exiting the channels at partial throttle openings collide in a region of the intake passageway downstream from the throttle blades to form a region of severe turbulence for finely atomizing liquid fuel in the fuel/air mixture.

These and other objects will become more clear from the following description when considered in conjunction with the several Figures, wherein like reference numerals refer to like parts throughout.

DETAILED DESCRIPTION OF THE PREFERRED EMBODIMENT

Figure 1:
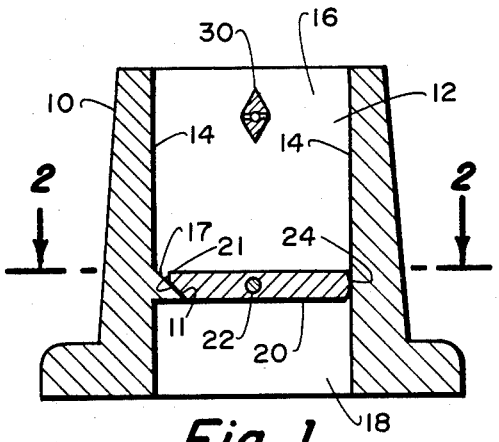
FIG. 1 is a cross sectional view parallel to the throttle shaft axis of one embodiment of a carburetor mixing and modulating throttle assembly utilizing the principles of the present invention.

Referring to FIG. 1, there is provided an embodiment of the present invention having a throttle body, generally indicated at 10. Throttle body 10 has interior walls 14 which define an air intake passageway, of rectilinear cross section, generally indicated at 12. The air intake passageway 12 has an upstream end, generally indicated at 16, and a downstream end, generally indicated at 18. The downstream end of the throttle body is adapted for connection to the air intake of an internal combustion engine (not shown) for supplying the fuel/air mixture thereto. The upstream end of the intake passageway is adapted to communicate with the atmosphere, preferably through a conventional air filter (not shown). Air for forming the fuel/air mixture flows through the air intake passageway in the direction of upstream to downstream. Butterfly type throttle blade 20 is located in the air intake passageway 12, and adapted to be affixed onto a shaft 22. Shaft 22 is journaled to rotate in throttle body 10; therefore the throttle 20 is rotatably disposed in the intake 12, and has an axis of rotation. Throttle blade 20 has surface 24 which cooperates with the air intake passageway wall 14 to form a seal, whereby the throttling action of throttle 20 is effected. Surface 24 is curved in a radius which is just slightly less than the distance from the wall 14 nearest surface 24 to the axis of rotation of throttle blade 20; therefore the surface 24 maintains close cooperation with surface 14 over several degrees of rotation of the throttle 20. The close cooperation of surface 24 with the wall 14 precludes substantial flow of intake mixture for the first several degrees of opening throttle rotation. FIG. 1 shows the throttle in the fully closed position; as the throttle rotates open to allow passage of greater amounts of intake mixture, it rotates in a clockwise direction. In the case of application for providing fuel to an automotive engine, the rotatable shaft 22 is adapted with suitable linkage (not shown) to be rotated by the vehicle operator. The throttle blade 20 is formed preferably by being precision machined from metal stock. Throttle 20 has surface 21 which cooperates closely with surface 11 of the throttle body. At fully closed throttle positions, surface 21 touches surface 11 to preclude substantial flow of intake mixture.

The cooperation between surfaces 11 and 21 forms a channel 17. The channel 17 is effectively closed at closed throttle positions. A fuel outlet 30 is positioned in intake passageway 12 upstream of the throttle blade 20. Fuel is delivered from outlet 30 to the intake air flowing through passageway 12, in proportion to the quantity of air flowing through intake 12, controlled by means (not shown), which may be any conventional means.

In the embodiment illustrated in FIG. 1, the throttle blade is shown in the fully closed position. The close cooperation of throttle blade edge 24 with wall 14, in addition to the closure formed by the cooperation of surface 11 with 21, forms a seal which precludes substantial flow of air through passageway 12 at closed throttle conditions. To allow flow of more fuel/air mixture through the passageway 12, the throttle is rotated to a more open position, which for FIG. 1 is the clockwise direction.

Figure 2:
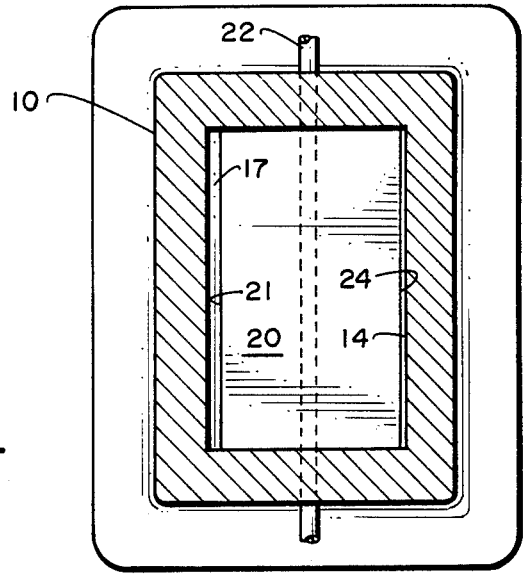
FIG. 2 is a top view of the embodiment of FIG. 1, taken along the line 2—2.

FIG. 2 illustrates a top view of the embodiment of FIG. 1, taken along the line 2—2. Note that the cross section of the intake 12 is preferably rectilinear.

For a detailed description of the operation of the invention, it will be assumed that the engine fueled through the present invention has been started and is operating at idle load conditions. Referring to FIG. 1, the fully closed throttle blade precludes substantial flow through passageway 12, so the majority of engine idle fuel/air mixture would have to be supplied by an auxiliary means (not shown). Otherwise, the throttle blade 20 would have to be rotated to a more open position to supply the required engine idle air.

Figure 3:
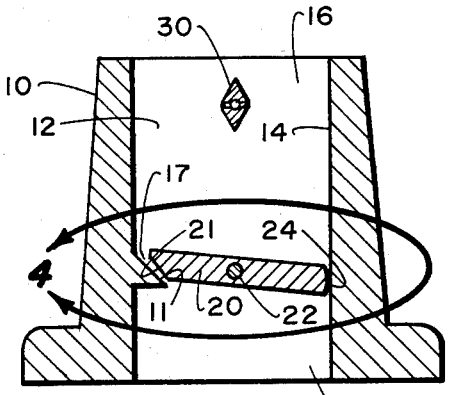
FIG. 3 is a cross sectional view showing an embodiment as in FIG. 1 with the throttle in a partially open position.

As more intake air is required by the engine, the throttle blade is rotated to a more open position, as shown in FIG. 3. The arrow 4 indicates that the throttle pivots about the shaft axis. As the throttle rotates open, as shown in FIG. 3, surface 21 moves away from cooperating surface 11. It should be appreciated at this point that there are two potential flow paths for intake air past the partially open throttle blade: one path is between blade edge 24 and wall 14; the other path through the channel 17. The sides of the throttle blades, not visible in this Figure but shown as 28 in a subsequent Figure, remain in close cooperation with the walls 14 throughout the entire range of partially open throttle positions so as to effectively provide a seal against flow of mixture. For the initial few degrees of opening throttle movement from the fully closed position, the curved edge 24 is moving in close cooperation to wall 14; therefore there is no appreciable air flow between surface 24 and 14. However, for the same few degrees of initial throttle movement, the surface 21 is moving perpendicular to surface 11; thus the channel 17 opens relatively rapidly. Therefore, the increase in air flow here is rapid. The result is that, for the initial part of opening the throttle blade from the closed position, essentially all the fuel/air mixture flow is through the channel 17.

At partial throttle opening positions, as shown in FIG. 3, fuel is delivered from outlet 30 to the intake air as liquid droplets. The resultant fuel/air mixture flows in a downstream direction toward the throttle blade. At small throttle openings, substantially all the fuel/air mixture flows through the channel 17, so the fuel/air mixture downstream of outlet 30 begins to move laterally toward the upstream entrance of the channel 17. The fuel/air mixture then enters the channel. To more closely examine the flow through the channel, reference is had to FIG. 4.

Figure 4:
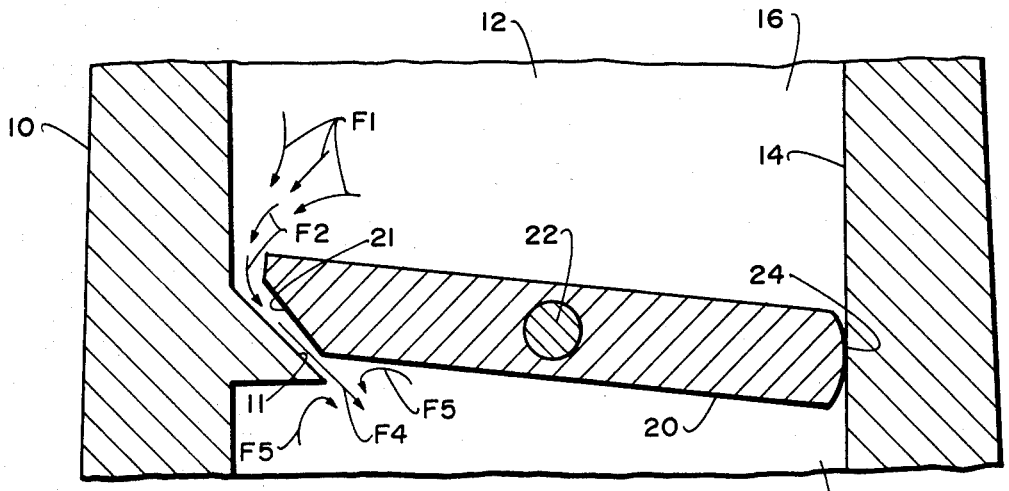
FIG. 4 is an enlarged cross sectional view of the cooperation of the throttle blade with the throttle body of the embodiment illustrated in FIG. 3.

FIG. 4 is an enlargement of the channel area of FIG. 3, with arrows to indicate fuel/air mixture flow. Initially, the fuel/air mixture upstream of the throttle, before entering the channel, has moved laterally toward the entrance to the channel 17, as shown by the arrows labeled F1. As the fuel/air mixture enters the restriction formed by the channel 17, the flow is accelerated to a high speed stream, due to the large pressure difference that exists across the throttle, and therefore across the channel, when the engine is operating under partial throttle conditions. This high speed flow is indicated by the arrows labeled F2. As the high speed fuel/air mixture stream exits the channel, as shown by arrow F4, counterflow eddies form, as indicated at F5. These counterflow eddies tend to carry any liquid fuel which separates onto the surfaces 11 or 21 back into the high speed channel flow exit stream F4, where the turbulence causes thorough atomization to occur.

When an even greater flow of fuel/air mixture is required for higher engine power output, the throttle blade is rotated open still further. As the throttle blade is rotated to a more open position, surface 21 becomes quite distant from its cooperating surface 11. The tendency is now for the channel 17 to become indistinct from the overall passageway 12, as a whole. Also, at larger throttle openings, the separation between wall 14 and throttle edge 24 becomes significant, and thus a major contribution to the overall flow through passageway 12 passes through this increased separation.

Figure 5:
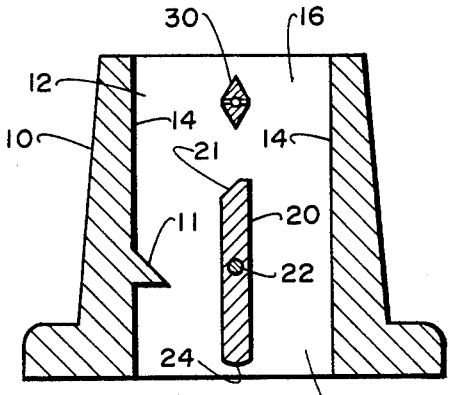
FIG. 5 is a cross sectional view showing an embodiment as in FIG. 1, with the throttle in a fully open position.

FIG. 5 illustrates the embodiment of FIG. 1, with the throttle blade rotated open to the maximum extent. It is very evident from FIG. 5 that the channel has deformed to the extent that it is not a recognizable entity at maximum throttle openings. Thus, the fuel/air mixture flows freely to the engine for maximum power.

The foregoing embodiment of the invention is capable of efficient mixing and modulating of the fuel/air mixture, especially at partial throttle openings. It is very common for the pressure difference across the throttle blade to be great enough to cause the mixture speed through the channel to flow at sonic velocities for most of the operating conditions common to present day engines in automotive use. Thus, fuel droplets passing through the channel will be subjected to severe levels of turbulence in, and upon exiting the channel. This condition results in very efficient atomization of the liquid fuel, where the term atomization refers to breaking liquid fuel droplets down into smaller droplets.

It is not important what type of device is employed for the fuel outlet 30. For purpose of simplicity, the fuel outlet may be one of the many designs which use a venturi signal to meter the proper quantity of fuel into the passageway 12. However, any injection method would work equally well. A plurality of fuel outlets might even prove advantageous for evenly distributing the fuel into the mixture at large throttle openings.

With reference particularly to FIG. 4, it will be noted that the fuel/air mixture changes velocity rapidly at the entrance to the channel. This rapid change in velocity tends to cause liquid fuel to separate out of the mixture onto the surface 11. In this embodiment of the invention, fuel which separates onto surface 11 flows along the surface until it reaches the region of the downstream end of the channel. At this point, the counterflow eddies F5 tend to cause this separated fuel to re-enter the exit stream F4 from the channel, and be finely atomized by the turbulence that exists at the boundary areas between the flow of the exit stream from the channel and the relatively slow moving mixture which predominates in the volume of the intake passageway downstream of the throttle at partial throttle openings.

It was previously mentioned that the channel opens quickly as the throttle blade is rotated from the closed position. Thus, the mixture supply to the engine increases quickly for very small increases in throttle opening. In the conventional configurations for butterfly type throttle valves as used in automotive carburetors, all edges of the blade which cooperate with the throttle body for seal formation move initially from idle in a direction that is essentially parallel to the intake walls. Thus, initial mixture flow increase in gradual, and the throttle pivot shaft can be advantageously operated directly from a foot-controlled linkage. In the embodiment of the present invention just described, initial flow increase from idle is extremely rapid, and the rate of flow increase may need to be controlled by rotating the throttle indirectly. This might be accomplished by a method such as using a specially profiled cam to open the throttle, where the vehicle operator foot-controlled linkage operates the cam.

Also, since the channel opens rapidly from the closed throttle position, the channel attains a substantial cross section before significant flow occurs between the blade edge 24 and the wall 14. In many embodiments of the present invention for automotive application, the intake mixture flow is substantially only through the channel even at maximum cruising speed of the vehicle. Thus, the enhanced atomization characteristics provided by the flow through the channel are realized for most vehicle operating conditions, the exception being rapid acceleration.

Figure 6:
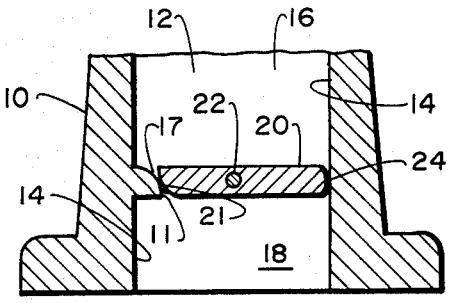
FIG. 6 is a cross sectional view of one embodiment of the present invention wherein the novel channel has a first convergent, then divergent configuration.

FIG. 6 illustrates a section through the throttle region of the air intake of an embodiment of the present invention, showing how the surfaces 11 and 21 can be curved such that an advantageous cross section for the channel 17 is achieved. In FIG. 6, the portion of the throttle blade having surface 21 is formed in a curved shape for cooperation with surface 11, which is also curved. The resultant cooperation forms channel 17 which has a cross section that is first convergent, then divergent. This results in a flow through the channel where the mixture is accelerated to a high speed in the convergent part, then decelerated in the divergent part, where the divergent shape acts as a diffuser to recover the kinetic energy of the stream as static pressure. Shapes such as this can ensure high velocity mixture flow through the channel even when engine intake vacuum falls to lower levels. This convergent-divergent type of configuration is commonly found in carburetors wherein supersonic flow is used to finely atomize the fuel.

Figure 7:
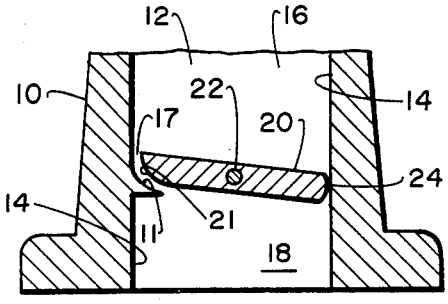
FIG. 7 is a cross sectional view of one embodiment of the present invention wherein the novel channel has a curved configuration.

FIG. 7 illustrates a section through the throttle region of the air intake of an embodiment of the present invention wherein separation of liquid fuel is encouraged at partial throttle openings. The surfaces 11 and 21 are curved with similar radii, as illustrated, in a direction which tends to direct the channel exit stream more parallel to the downstream surface of the throttle blade. The channel could also be curved in the opposite direction (not shown), which would tend to guide the channel exits stream back toward the mixture flow axis of the passageway 12. FIG. 7 shows the throttle blade in a partially open position. In the operation of this configuration of the invention, the high speed mixture stream flows around the curve of the channel 17. Due to this curved shape, larger fuel droplets tend to centrifuge out of the mixture onto surface 11. Normally, this separated fuel would re-enter the high speed channel exit streams due to the existence of the counterflow eddies, as previously described. This formerly separated fuel will be finely atomized by the severe turbulence at the channel exit stream boundaries.

Figure 8:
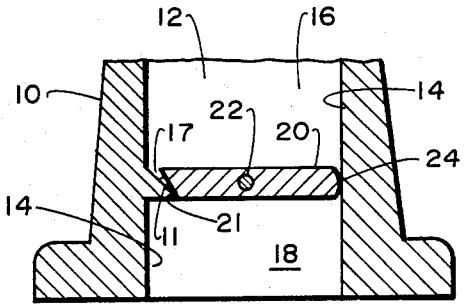
FIG. 8 is a cross sectional view of one embodiment of the present invention wherein the novel channel has essentially straight walls in a convergent configuration.

FIG. 8 illustrates a cross section through the throttle area of the air intake of an embodiment of the present invention, wherein the surfaces 11 and 21 are not parallel when the throttle is in the closed position. In the closed position, the angles of surfaces 11 and 21 give the channel 17 a convergent cross section. This has been shown to provide advantageous operation at small load engine conditions, when the opening of the channel is very small.

Figure 9:
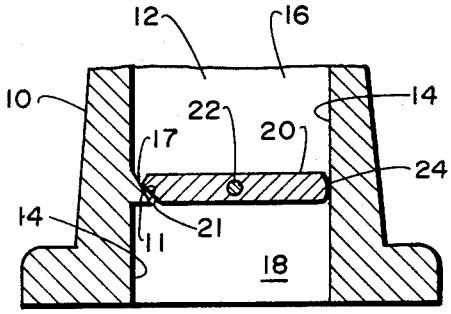
FIG. 9 is a cross sectional view of one embodiment of the present invention wherein the novel channel has essentially straight walls in a divergent configuration.

FIG. 9 illustrates a cross section through the throttle area of the air intake of an embodiment of the present invention, wherein the surfaces 11 and 21 are not parallel when the throttle is in the closed position. In the closed position, the angles of surfaces 11 and 21 give the downstream portion of the channel a divergent cross section. This can provide advantageous functioning of the channel at larger openings of the throttle.

Figure 10:
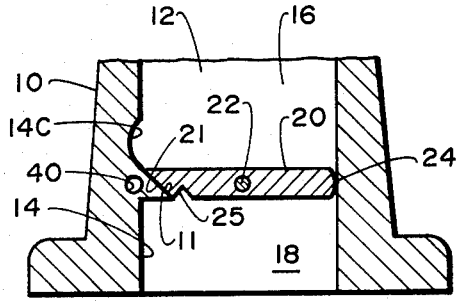
FIG. 10 is a cross sectional view of one embodiment of the present invention wherein the throttle blade is shaped for control of separated fuel, and a heat passageway is provided.

FIG. 10 illustrates a cross section through the throttle area of the air intake of an embodiment of the present invention, showing several alternate configurations for the operation of the invention. In FIG. 10, a cut out area or notch 25 is formed in the downstream surface of throttle blade 20. This notch presents a sharper angle to the exit surface of the throttle blade side of the channel 17, resulting in diminished fuel separation onto the downstream surface of the throttle blade. This sharper angle also aids the counterflow eddies in returning separated fuel to the high speed exit stream from the channels. A curved protion **14*c* of the wall 14 provides additional clearance for the end of the throttle blade, and can aid in the control of the mixture flow entering the channel. A passageway 40 is provided in the throttle body in the vicinity of the surface 11. Passageway 40 conducts a heated fluid, such as engine coolant or exhaust, for imparting heat to surface 11. This heat aids in vaporizing liquid fuel which separates onto surface 11**.

Figure 11:
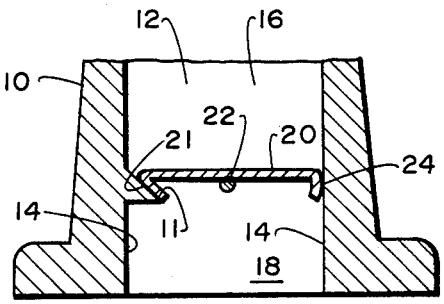
FIG. 11 is a cross sectional view of a throttle blade in an embodiment of the present invention, where the throttle blade is formed of stamped metal sheet.

FIG. 11 illustrates a cross section through the throttle area of the air intake of an embodiment of the present invention where the throttle blade is inexpensively formed by stamping from sheet or strip metal stock. The throttle blade is machined to the final precision tolerances. This embodiment functions like the embodiment of FIG. 1; the difference being the nature of the construction of the throttle blade.

Figure 12:
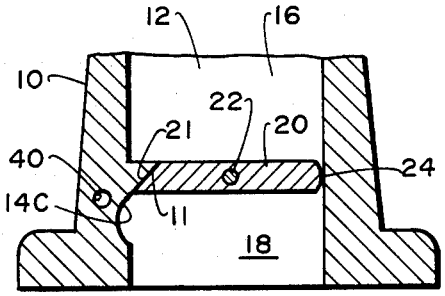
FIG. 12 is a cross sectional view of an embodiment of the present invention wherein the novel channel angles outwardly from the shaft axis of the throttle blade.

FIG. 12 illustrates a cross section through the throttle area of the air intake of an embodiment of the present invention where the channel is formed such that the exit stream of fuel/air flow is directed towards the wall 14. In this embodiment, the throttle rotates in a counterclockwise direction to more open positions. This embodiment of the invention can cause enhanced separation of the liquid fuel onto the surface **14*c*, which normally functions as a clearance for the end of the throttle blade. Thus, passageway 40** could provide heat to assist in vaporizing the separated fuel.

Figure 13:
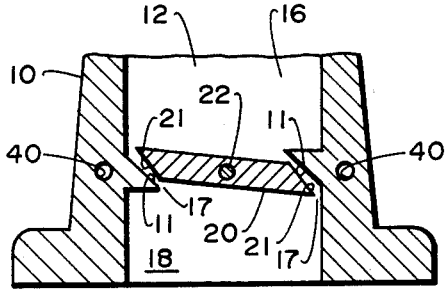
FIG. 13 is a cross sectional view of an embodiment of the present invention wherein a single throttle blade forms two channels.

FIG. 13 illustrates a cross section through the throttle area of the air intake of an embodiment of the present invention combining the channel features of the embodiments of FIGS. 1 and 12 in a single throttle blade. The throttle blade rotates in a clockwise direction to flow more mixture to the engine.

Figure 14:
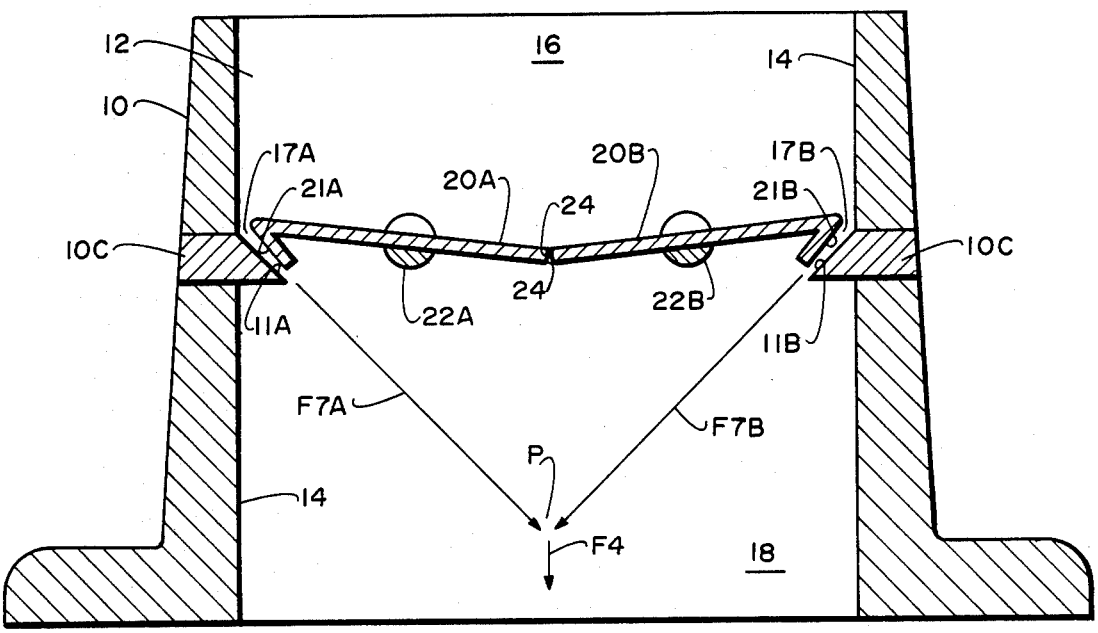
FIG. 14 is a cross sectional view of an embodiment of the present invention wherein two throttle blades are disposed in a common intake passageway.

FIG. 14 illustrates an embodiment of the present invention wherein two throttle blades are provided in the air intake passageway. Disposed in intake passageway 12 are butterfly type throttle blades 20A and 20B. Throttle blade 20A is affixed to rotatable shaft 22A, and throttle blade 20B is affixed to rotatable shaft 22B. Shafts 22A and 22B are rotatably interconnected for coordinated rotation in opposite directions by gear means (not shown). For opening motion of the throttles shown in FIG. 14, shaft 22A rotates in a clockwise direction, while shaft 22B rotates an equal number of degrees in a counterclockwise direction. In the case of application for providing fuel to an automotive engine, the rotatably interconnected shafts are adapted with suitable linkage (not shown) to be rotated by the vehicle operator. The throttle shafts 22A and 22B are positioned in the intake 12 such that their axes of rotation are essentially parallel to one another. The throttle blades 20A and 20B are preferably formed by being stamped from sheet or strip metal stock and precision machined to final shape and tolerance. The throttle blade/shaft assemblies are located in the intake passageway 12 such that when the throttles are in the fully closed position, the edges 24 of the throttle blades cooperate closely, but with a small amount of clearance, at their position of closest proximity central in the air intake, to preclude substantial flow of mixture through the clearance at small throttle openings. The edges 21A and 21B cooperate with the surfaces 11A and 11B respectively to form channels 17A and 17B. The surfaces 11A and 11B are formed as part of section 10C of the throttle body 10. The section 10C can be constructed so as to be movable in the body 10, and hence can be positioned to adjust the exact amount of clearance between the throttle blades and the throttle body after the system is assembled.

In operation, each of the channels functions as previously described for a single channel. One of the principal advantages of this configuration is that the exit streams from the channels 17A and 17B, shown respectively at F7A and F7B, can be advantageously caused to converge downstream of the throttles, as shown at collision point P. The severe turbulence at the point of collision causes the liquid fuel to be finely atomized. After colliding, the mixture flows downstream as shown at F4.

Figure 15:
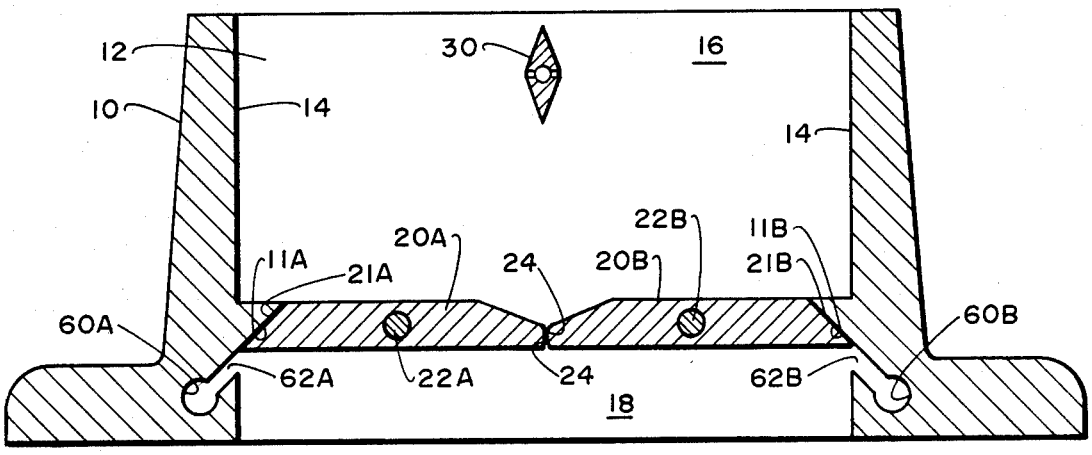
FIG. 15 is a cross sectional view of an embodiment of the present invention having two throttle blades and wherein the mixture streams are directed into passageways.

FIG. 15 illustrates an embodiment of the invention wherein two throttle blades, operating in a similar manner to the configuration of FIG. 12, are located in the air intake passageway. In FIG. 15, throttle surfaces 21A and 21B cooperate with surfaces 11A and 11B respectively to form channels 17A and 17B. The channels function as described for the channel of FIG. 12. In this embodiment, the exit streams from the channels at part throttle operation can be directed at the passageways 62A and 62B. The mixture will then flow to passageways 60A and 60B which transport the fuel to a heater (not shown) where heat is imparted to the liquid fuel to vaporize it. The resultant vaporized fuel mixture is then returned to the passageway 12 downstream from the throttles (not shown).

Figure 16:
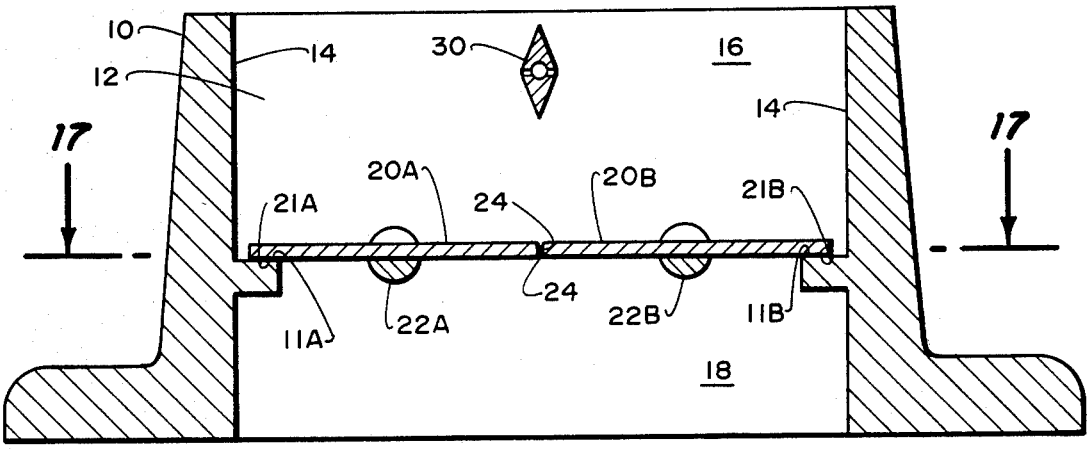
FIG. 16 is a cross sectional view of an embodiment of the present invention wherein the throttle blades are formed inexpensively from sheet or strip stock.

FIG. 16 illustrates an embodiment of the invention wherein the throttle blades are easily and inexpensively formed by being stamped from sheet or strip stock. The surfaces 11A and 11B are also formed as a more simple shape on the throttle body. In FIG. 16, the channel exit streams flow along the downstream surfaces of the throttle blades, and may impinge on the throttle shafts 22 before colliding.

Figure 17:
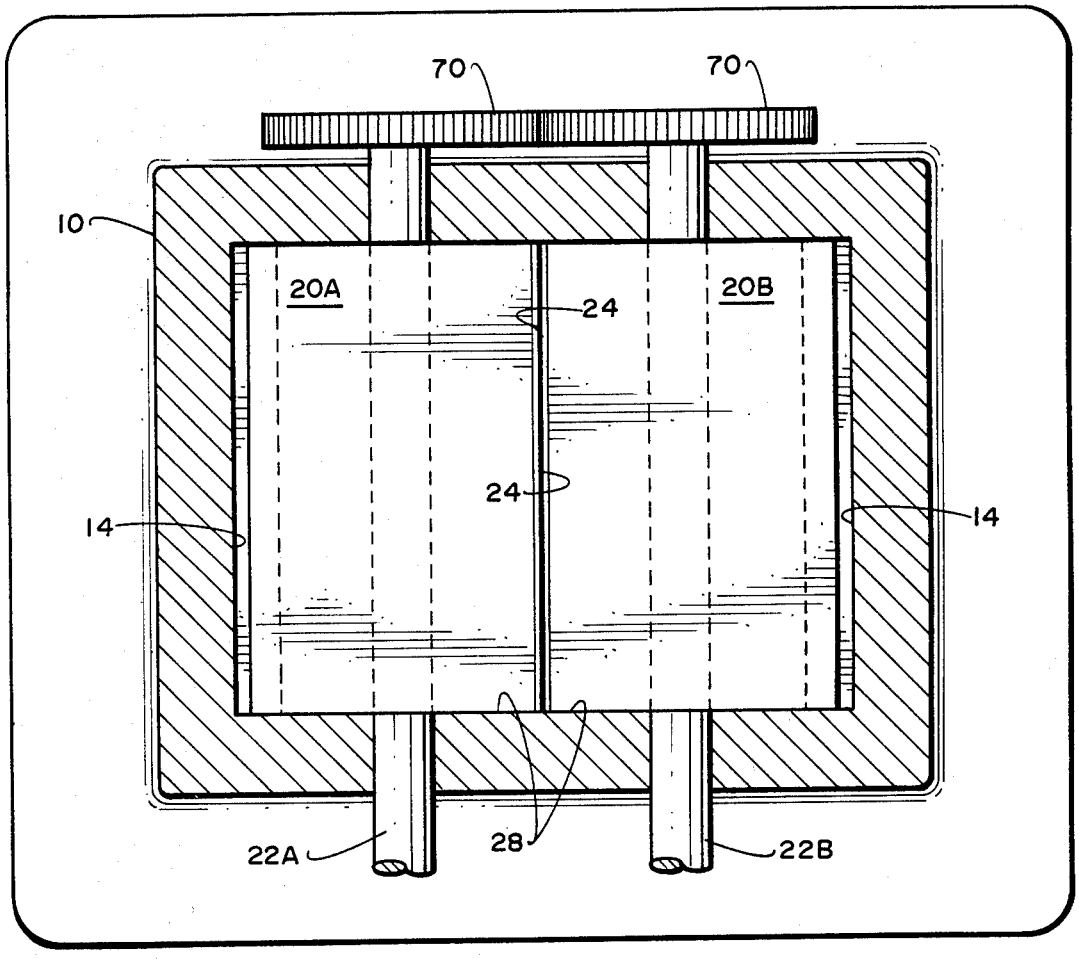
FIG. 17 is a top view of the embodiment of FIG. 16, taken along the line 17—17.

FIG. 17 illustrates a top view of a section of the embodiment of FIG. 16, taken along the line 17—17. Illustrated more clearly in FIG. 17 are the synchronous gears 70 which drive the shafts 22A and 22B. Also shown are the sides 28 of the throttle blades, which maintain close cooperation with the walls 14 of the air intake to effect a seal.

Figure 18:
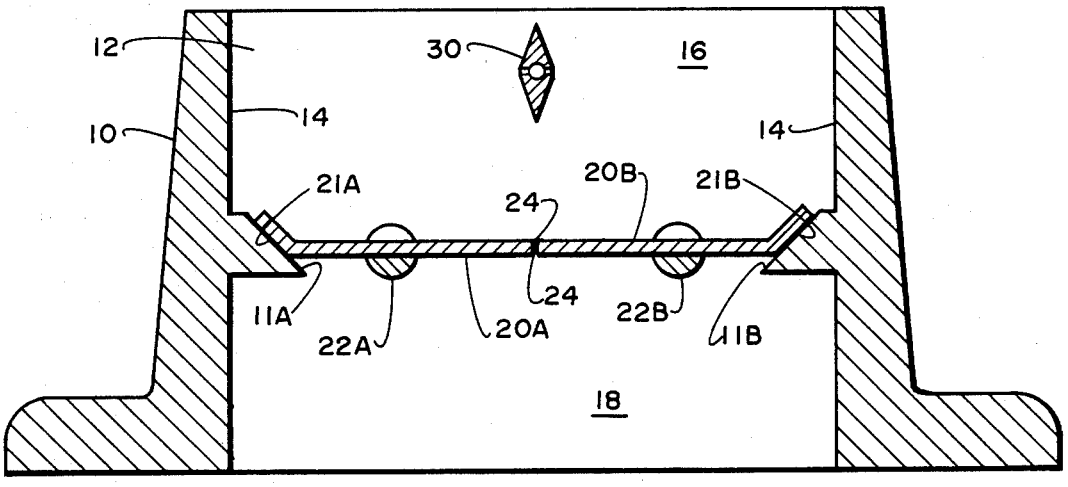
FIG. 18 is a cross sectional view of an embodiment of the present invention wherein the throttle blades are formed inexpensively from sheet or strip stock.

FIG. 18 is an improvement on the invention of FIG. 16, wherein the throttle blades are stamped from sheet or strip metal stock, but formed with an easily created angle so that the channel exit streams flow away from the throttle surfaces and collide further downstream from the throttle blades.

Figure 19:
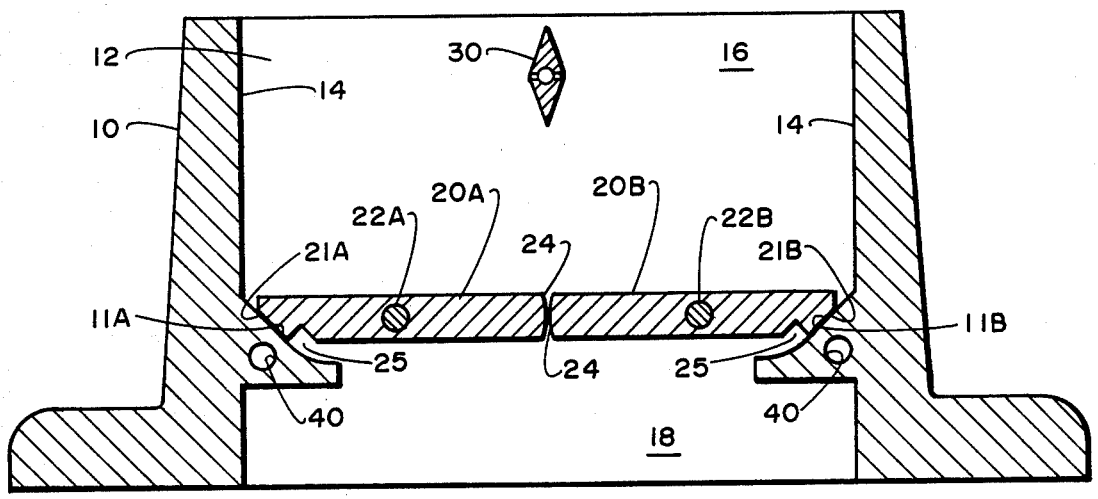
FIG. 19 is a cross sectional view of an embodiment of the present invention wherein a portion of the throttle blade is shaped.

FIG. 19 illustrates an embodiment of the invention employing two throttle blades of the type described in FIG. 10. In the embodiment of FIG. 19, the surfaces 11A and 11B are extended, and the extended part curved to direct the channel exit mixture streams to converge at a point closer to the downstream surfaces of the throttle blades 20A and 20B. Additionally, the curve of the extended part of 11A and 11B enhances centrifugal separation of liquid fuel from the channel exit streams.

Figure 20:
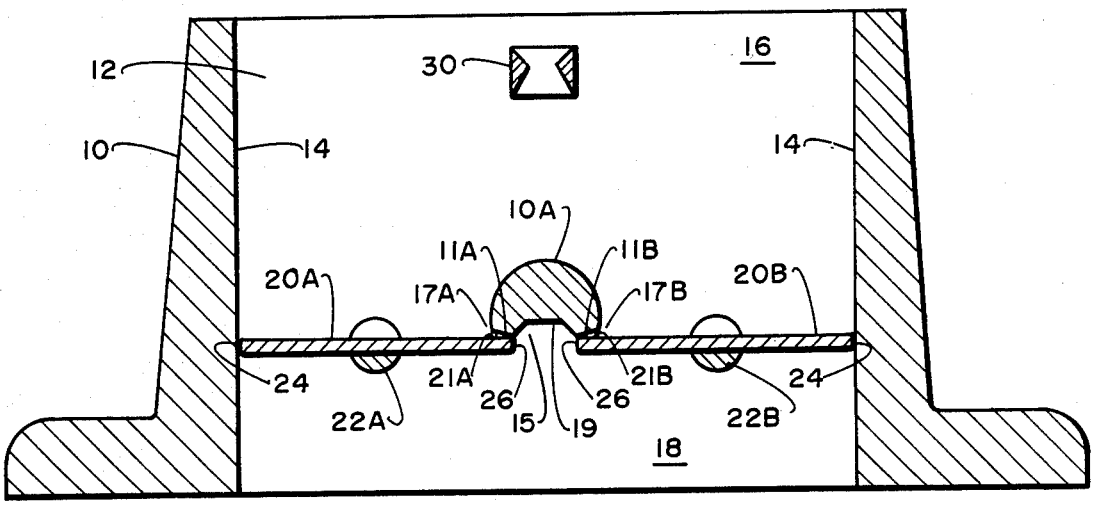
FIG. 20 is a cross sectional view of one embodiment of the present invention wherein the channels are formed at a location of cooperation with a transverse extension of the throttle body.

Referring now to FIG. 20, there is illustrated a further embodiment of the present novel fuel/air mixing and modulation device having the channels formed by the cooperation of the throttle blades with an extension of the throttle body extending transversely across the central portion of the air intake passageway.

In the configuration of FIG. 20, there is a throttle body generally indicated at 10. The throttle body is adapted to be connected to the induction intake passageway of an internal combustion engine (not shown) for supplying a fuel/air charge thereto. Throttle body 10 defines an internal air intake passageway, of rectilinear cross section, generally indicated at 12. The walls 14 of throttle body 10 bound the air intake 12. Air intake 12 has an upstream end, generally indicated at 16, and a downstream end, generally indicated at 18. Induction air for supply to the engine flows through the intake passageway 12 in the direction of upstream to downstream. The upstream end of the passageway is adapted to communicate with the atmosphere, preferably through a conventional air filter (not shown). Extending transversely across the central part of intake passageway 12 is an extension 10A of the throttle body 10. A recessed region 19 is formed in the transverse extension 10A. Disposed in intake passageway 12 are butterfly type throttle blades 20A and 20B. Throttle blade 20A is affixed to rotatable shaft 22A, and throttle blade 20B is affixed to rotatable shaft 22B. The shafts 22A and 22B are formed with a flat surface suitable for accomodating the flat throttle blades 20A and 20B for mounting. Shafts 22A and 22B are rotatably interconnected for coordinated rotation in opposite directions by gear means (not shown). For opening motion of the throttles shown in FIG. 20, shaft 22A rotates in a clockwise direction, while shaft 22B rotates an equal number of degrees in a counterclockwise direction. In the case of application for providing fuel to an automotive engine, the rotatably interconnected shafts are adapted with suitable linkage (not shown) to be rotated by the vehicle operator. The throttle shafts 22A and 22B are positioned in the intake 12 such that their axes of rotation are essentially parallel to one another. The throttle blades 20A and 20B are rectangular, and preferably formed by being stamped from sheet or strip metal stock and precision machined to final shape and tolerance. The throttle blade/shaft assemblies are located in the intake passageway 12 such that when the throttles are in the fully closed position the edges 24 of the throttle blades cooperate closely with the walls 14 to preclude substantial flow of intake air through the passageway 12. The transverse extension 10A of the throttle body has surfaces 11A and 11B. Throttle blades 20A and 20B have surfaces 21A and 21B respectively, such that surface 11A cooperates with surface 21A, and surface 11B cooperates with surface 21B. The lines of cooperation of surfaces 11A, 11B, 21A, and 21B are essentially parallel to the axes of rotation of the throttle blades such that at fully closed throttle positions surface 11A touches along surface 21A, and surface 11B touches along surface 21B to form a seal to preclude substantial flow of air past these cooperating surfaces. At closed throttle blade positions, a substantial amount of clearance is provided between the edges 26 of blades 20A and 20B which are nearest one another centrally in passageway 12. This clearance forms a flow region which is indicated generally at 15. The cooperation between surfaces 11A and 21A forms a channel 17A; the cooperation between surfaces 11B and 21B forms a channel 17B. Channels 17A and 17B are effectively closed at closed throttle positions. A fuel outlet 30 is positioned in intake passageway 12 upstream of the throttle blades 20A and 20B. Fuel is delivered from outlet 30 to the intake air flowing through passageway 12, in proportion to the quantity of air flowing through intake 12, controlled by means (not shown), which may be any conventional means.

In the embodiment illustrated in FIG. 20, the throttle blades are shown in the fully closed position. The close cooperation of throttle blade edges 24 with walls 14, in addition to the closure formed by the cooperation of surface 11A with 21A and surface 11B with 21B, forms a seal which precludes substantial flow of air through passageway 12 at closed throttle conditions.

For a detailed description of the operation of this embodiment of the invention, it will be assumed that the engine fueled through the present invention has been started and is operating at idle load conditions. Referring to FIG. 20, the fully closed throttle blades preclude substantial flow through passageway 12, so the majority of engine idle fuel/air mixture would have to be supplied by an auxiliary means (not shown). Otherwise, the throttle blades 20A and 20B would have to be rotated to a more open position to supply the required engine idle air.

Figure 21:
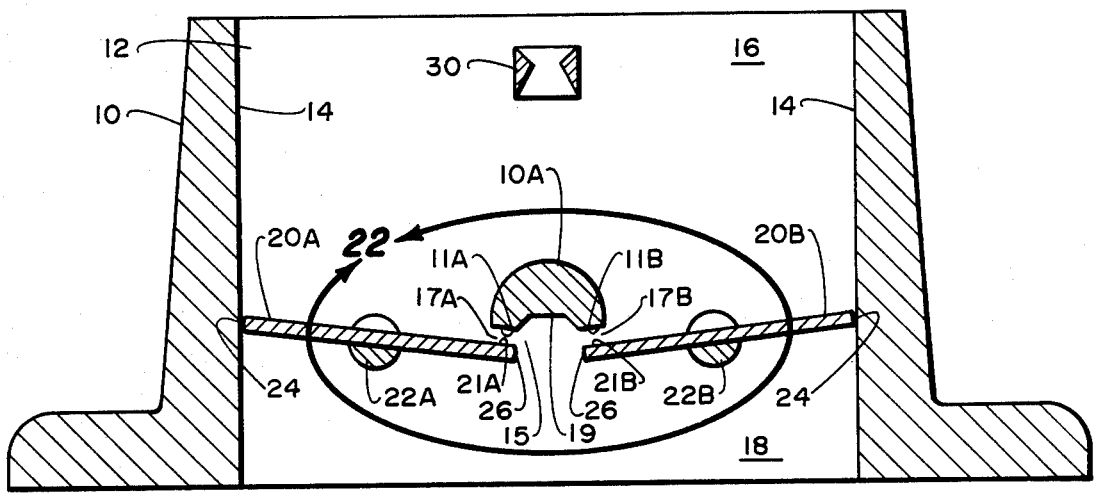
FIG. 21 is a cross sectional view showing the embodiment as in FIG. 20, with the throttles in a partially open position.

As more intake air is required by the engine, the throttle blades are rotated to a more open position, as shown in FIG. 21. Since the throttle shafts are adapted for coordinated rotation in opposite directions, they rotate open as shown in FIG. 21 where surfaces 21A and 21B move away from their respective cooperating surfaces 11A and 11B. Thus, throttle 22A rotates open in a clockwise direction, while throttle 22B rotates open in a counterclockwise direction. Arrow 22 indicates the opening rotation of the throttles. It should be appreciated at this point that there are two potential flow paths for intake air past the partially open throttle blades: one path is between blade edges 24 and walls 14; the other path through the channels 17A and 17B. For the initial few degrees of opening throttle movement from the fully closed position, the edges 24 are moving essentially parallel to walls 14; therefore the rate of increase of the opening between these cooperating surfces is at its minimum. Thus, there is little appreciable increase of air flow between surfaces 24 and 14. However, for the same few degrees of initial throttle movement, the surfaces 21A and 21B are moving perpendicular to surfaces 11A and 11B respectively; thus the channels 17A and 17B open relatively rapidly. Here, the increase in air flow is rapid. The result is that, for the initial part of opening the throttle blades from the closed position, essentially all the fuel/air mixture flow is through the channels 17A and 17B.

At partial throttle openings as shown in FIG. 21, fuel is delivered from outlet 30 to the intake air as liquid droplets. The resultant fuel/air mixture flows in a downstream direction toward the throttle blades. At small throttle openings, substantially all the fuel/air mixture flows through the channels 17A and 17B, so the fuel/air mixture downstream of outlet 30 begins to move laterally toward the center of the passageway 12 preparatory to entering the channels 17A and 17B. The fuel/air mixture then enters the channels. Since the channels have essentially equal flow areas, the total flow through the passageway 12 will divide itself equally to flow through the channels. To more closely examine the flow through the channels, reference is had to FIG. 22.

Figure 22:
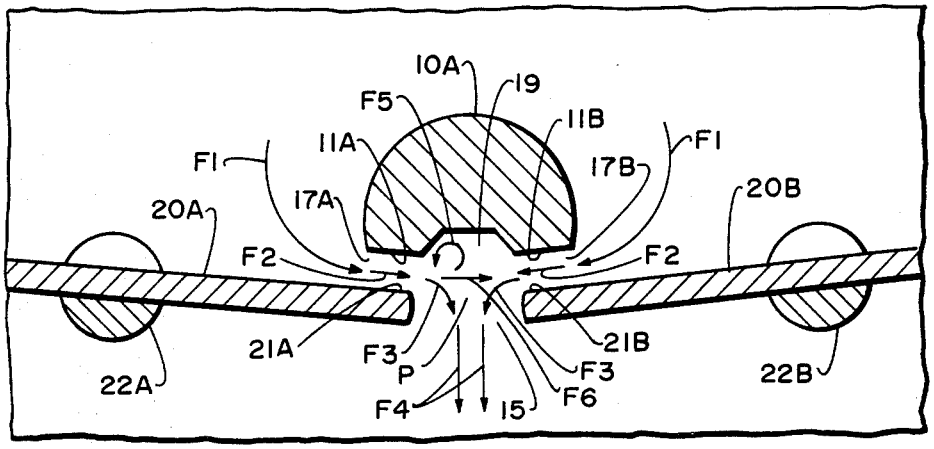
FIG. 22 is an enlarged cross sectional view of the throttle blade cooperation region of the embodiment illustrated in FIG. 21, showing mixture flow paths.

FIG. 22 is an enlargement of the channel area of FIG. 21, with arrows to indicate fuel/air mixture flow. Initially, the fuel/air mixture upstream of the throttles, before entering the channels, has divided itself into equal flows, shown by arrows labeled F1. As the fuel/air mixture enters the restriction formed by the channels 17A and 17B, the flow is accelerated to high speed streams, due to the large pressure difference that exists across the throttles, and therefore across the channels, when the engine is operating under partial thorttle conditions. This high speed flow is indicated by arrows labeled F2. Note that the streams from the channels 17A and 17B are now flowing towards one another. As the high speed streams exit the channels into region 15, they collide in region 15 as indicated at P. This collision causes the streams to undergo a severe change in velocity, which results in an overall change in the flow direction of fuel/air mixture as indicated by the arrows F3, and resultant movement in a direction parallel to the axis of passageway 12, as indicated by the arrows F4. The presence of recess 19 in extension 10A results in the formation of counterflow eddies indicated at F5. These counterflow eddies tend to carry any liquid fuel which separates onto the surface of extension 10A back into the high speed channel flow, where thorough atomization can occur.

A very advantageous effect of the flow through the channels 17A and 17B can now be seen, with reference to FIG. 22. Larger liquid fuel droplets, delivered by outlet 30, may be present in the intake air upstream of the throttles. These droplets would participate poorly in the combustion process, and result in engine inefficiency. As the large droplets are carried into the channels with the flow indicated by arrows F2, they are accelerated to the approximate velocity of the rest of the fuel/air mixture stream. This acceleration causes fuel droplets to be broken down into smaller droplets. Then, when the droplets in the channel exit streams reach the region P of stream collision, the inertia of the larger droplets causes them to traverse the region P and enter the flow of the opposing stream from the opposite channel. Arrow F6 shows the path of a larger fuel droplet as it exits channel 17A and traverses region P into the exit mixture flow from channel 17B. When a larger fuel droplet enters the opposing flow from the opposite channel, it experiences an extreme and rapid change in the relative flow of the surrounding fluids. The resultant shear effects reduce a large fuel droplet to many very small droplets. The result is very fine atomization of the liquid fuel passing through the channels, particularly at smaller throttle openings.

When an even greater flow of fuel/air mixture is required for higher engine power output, the throttle blades are rotated open still further. As the throttle blades are rotated to a more open position, surfaces 21A and 21B become quite distant from their cooperating surfaces 11A and 11B respectively. The tendency is now for the channels 17A and 17B to become indistinct from the overall passageway 12 as a whole. Also, at larger throttle openings, the separation between walls 14 and throttle edges 24 becomes significant, and thus a major contribution to the overall flow through passageway 12 passes through this increased separation.

Figure 23:
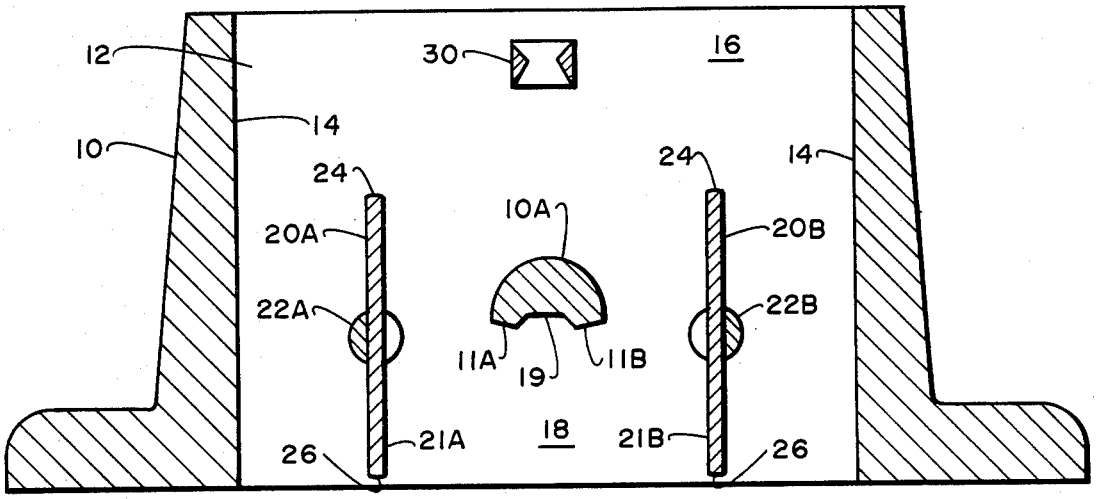
FIG. 23 is a cross sectional view showing an embodiment as in FIG. 20, with the throttles in a fully open position.

FIG. 23 illustrates the embodiment of FIGS. 20 and 21, with the throttle blades rotated open to the maximum extent. It is very evident from FIG. 23 that the channels have deformed to the extent that they are not recognizable entities at maximum throttle openings. Thus, the fuel/air mixture flows freely to the engine for maximum power.

The foregoing embodiment of the invention is capable of very efficient mixing and modulating of the fuel/air mixture, especially at partial throttle openings. It is very common for the pressure different across the throttle blades to be great enough to cause the mixture speed through the channels to flow at sonic velocities for most the the operating conditions common to present day engines in automotive use. Thus, any fuel droplet large enough to traverse the region of collision of the two channel exit streams into the stream of the opposite channel will quickly be in a situation where the relative mixture flow will approach twice sonic velocity in the opposite direction. This condition results in very efficient atomization of the liquid fuel, where the term atomization refers to breaking liquid fuel droplets down into smaller droplets.

It is not important what type of device is employed for the fuel outlet 30. For purposes of simplicity, the fuel outlet may be one of the many designs which use a venturi signal to meter the proper quantity of fuel into the passageway 12. However, any injection method would work equally well. A plurality of fuel outlets might even prove advantageous for evenly distributing the fuel into the mixture at large throttle openings.

It will be noted from FIGS. 20 through 23 that the surfaces 11A and 11B are angled slightly with respect to their respective cooperating surfaces 21A and 21B at closed throttle positions. The purpose of the angle is to provide channels that are of convergent cross section at very small throttle openings, and essentially even cross section at moderate throttle openings. These angular relationships have been shown to be advantageous for maximizing flow conditions through the channels and out from the channels, at intake flows representing most automotive operation situations, in a device that is economical to construct.

With reference particularly to FIG. 22, it will be noted that the fuel/air mixture changes velocity rapidly at the entrances to the channels. This rapid change in velocity tends to cause liquid fuel to separate out of the mixture onto the surfaces 21A and 21B of the throttles. At the exit ends of the channels, where the ends 26 of the throttle blades are located, this separated fuel tends to re-enter the exit streams from the channels and be finely atomized by the turbulence that exists in the region 15, and particularly where the re-entrant fuel crosses the region at P into the flow from the opposing channel, as previously described.

It was previously mentioned that the channels open quickly as the throttle blades are rotated from the closed position. Thus, the mixture supply to the engine increases quickly for very small increases in throttle opening. In the conventional configurations for butterfly type throttle valves as used in automotive carburetors, all edges of the blade which cooperate with the throttle body for seal formation move initially from idle in a direction that is essentially parallel to the intake walls. Thus, initial mixture flow increase is gradual, and the throttle pivot shaft can be advantageously operated directly from a foot-controlled linkage. In the embodiment of the present invention just described, initial flow increase from idle is extremely rapid, and the rate of flow increase may need to be controlled by rotating the throttle indirectly. This might be accomplished by a method such as using a specially profiled cam to open the throttles, where the vehicle operator foot-controlled linkage operates the cam.

Also, since the channels open rapidly from the closed throttle position, the channels attain a substantial cross section before significant flow occurs between the blade edges 24 and the walls 14. In many embodiments of the present invention for automotive application, the intake mixture flow is substantially only through the channels even at maximum cruising speed of the vehicle. Thus, the enhanced atomization characteristic of flow through the channels is realized for most vehicle operating conditions, the exception being rapid acceleration.

Figure 24:
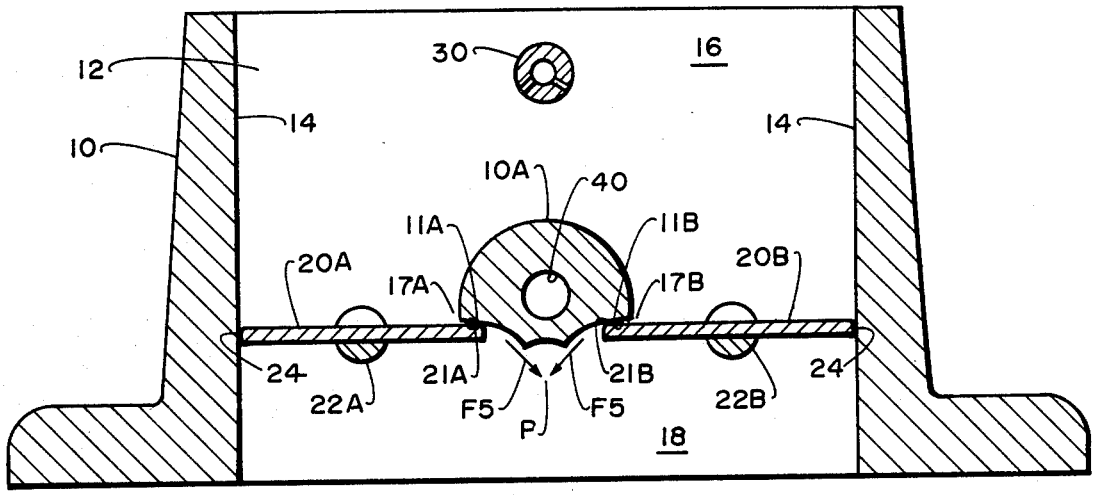
FIG. 24 is a cross sectional view of one embodiment of the present invention wherein the channel flow surfaces are curved.

FIG. 24 illustrates an embodiment of the present invention wherein separation of liquid fuel is encouraged at partial throttle openings. The surfaces 11A and 11B of the transverse extension 10A are curved, as illustrated, in a direction which guides the channel exit streams back toward the axis of the passageway 12. FIG. 24 shows the throttle blades in a closed position. When the blades are opened for increased mixture flow, the high speed mixture streams exiting the channels flow along the surfaces of extension 10A which are continuations of the surfaces 11A and 11B. Due to the curved shape of the flow guiding surfaces, larger fuel droplets tend to centrifuge out of the mixture onto the walls of extension 10A. Normally, this separated fuel would re-enter the high speed channel exit streams at the extremities of the flow surfaces of extension 10A. This formerly separated fuel will be finely atomized by the severe turbulence at the location P where the high speed streams converge. To further enhance the mixing of the fuel with the air, passageway 40 may be provided in extension 10A. Passageway 40 is adapted to carry a heated fluid, such as liquid engine coolant or engine exhaust, to impart heat to the extension 10A. By this means, the surfaces 11A and 11B and their extensions become heated. This heat is carried to the liquid fuel which has separated onto the surfaces of extension 10A, thereby enhancing vaporization of this separated fuel. By vaporization, it is meant that the liquid fuel is converted to a gasseous state. Vaporized fuel mixes thoroughly with the intake mixture, and contributes substantially to increased combustion efficiency. FIG. 24 also schematically represents fuel outlet 30 as a fuel rail which extends transversely across passageway 12, parallel to and upstream of extension 10A. This rail may be of the type where a plurality of small holes are provided along the rail to evenly distribute fuel into the intake passageway.

Figure 25:
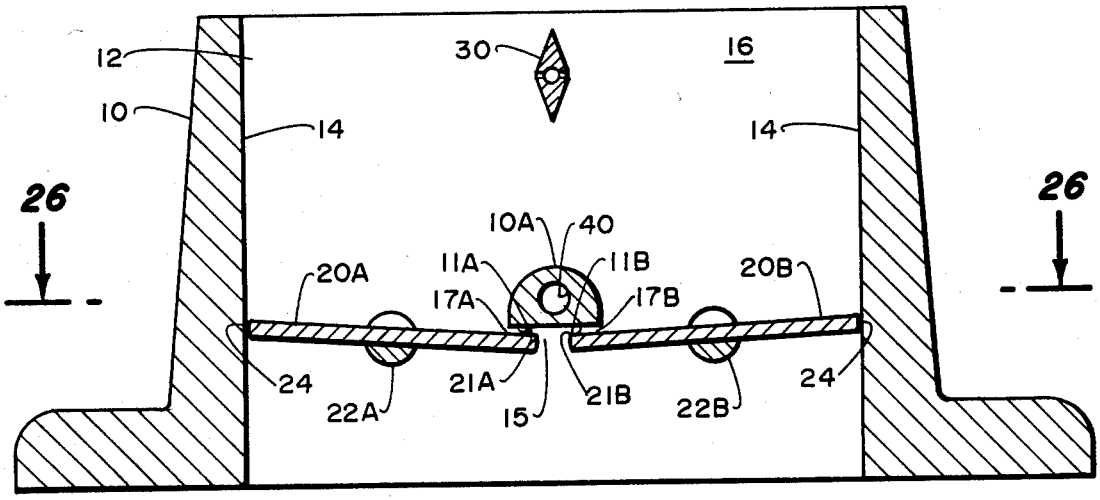
FIG. 25 is a cross sectional view of one embodiment of the present invention wherein cooperating surfaces are straight.

FIG. 25 illustrates an embodiment of the invention which is simple and economical to manufacture. The surfaces 11A and 11B are formed merely as part of the flat downstream surface of the transverse throttle body extension 10A. The throttle blades are shown in the partially open position. In embodiments of this kind, no recess is formed in the downstream surface of extension 10A. In the vicinity of collison point P of the channel exit streams, adjacent to the downstream surface of extension 10A, it has been shown that there exists a stagnant region of increased absolute pressure and low speed mixture flow. From this region liquid fuel tends to separate out of the mixture, eventually to re-enter the mixture in a manner which might result in less than optimal fuel atomization. In embodiments of this construction, it may be advantageous to provide heat from passageway 40 to assist in vaporizing the separated fuel.

Figure 26:
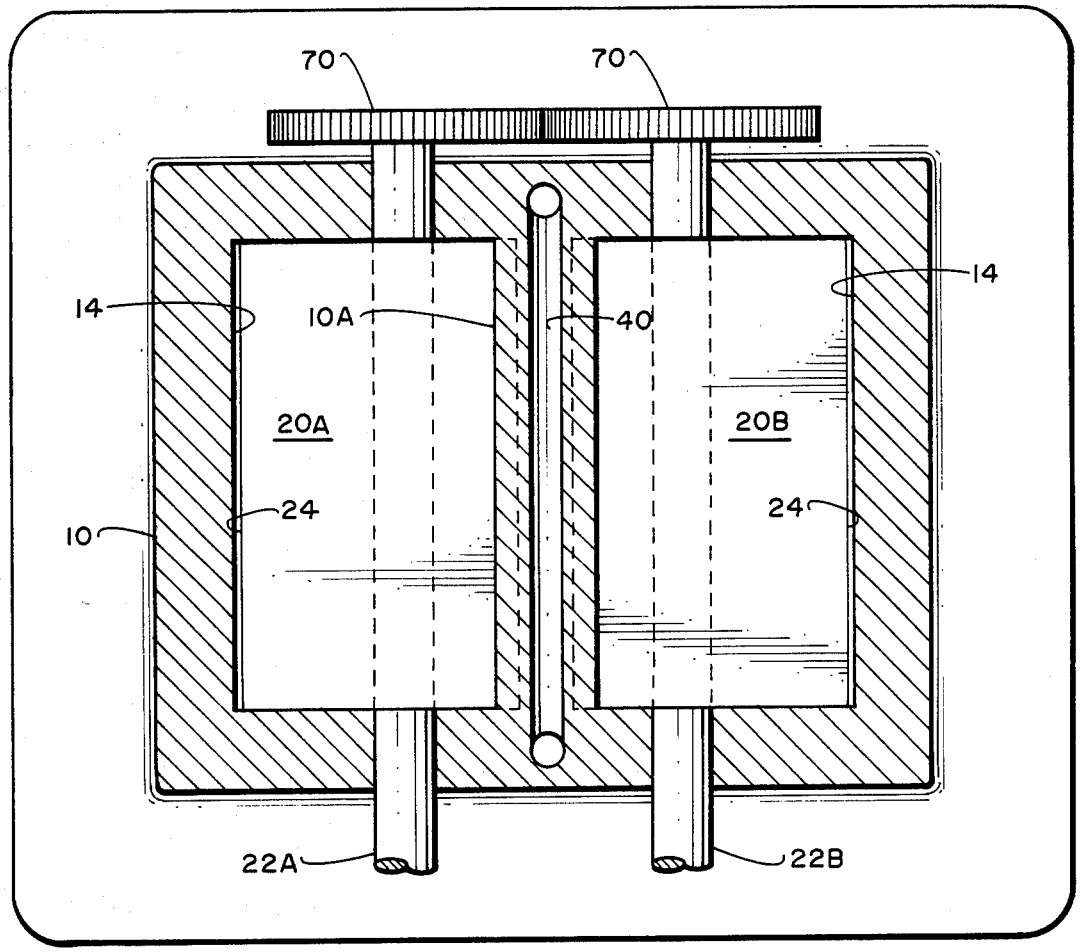
FIG. 26 is a top view of the embodiment of FIG. 25, taken along the line 26—26.

FIG. 26 illustrates a top view of a section of FIG. 25 taken along the line 26—26. Illustrated more clearly in FIG. 26 are the gears 70 which effect synchronous rotation of the shafts 22A and 22B. Also shown is the passageway 40 which transports the heated fluid.

Figure 27:
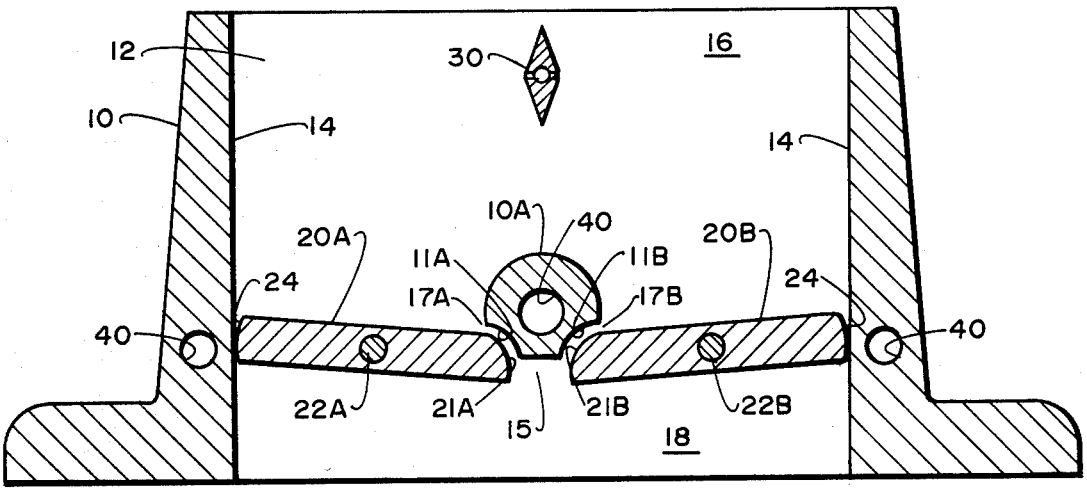
FIG. 27 is a cross sectional view of one embodiment of the present invention employing formed throttle blades and having curved partial throttle channels.

FIG. 27 illustrates an embodiment of the invention wherein the throttle blades may be formed by a process such as casting, or machined from solid stock, and precision machined to final tolerances. The throttle blades are thicker, and can be advantageously formed to enhance the function of the various surfaces which cooperate with the throttle body surfaces. In this embodiment, the edges 24 of the throttle blades which cooperate with the walls 14 of the throttle body 10 can be formed in a curved shape to more closely cooperate with the walls to preclude mixture flow over a greater range of rotation of the throttle blades. The channels illustrated here are more severely curved, to enhance separation of liquid fuel onto the extension 10A. The channel exit streams will converge further downstream in passageway 12, and at a lesser angle with reduced turbulence.

Figure 28:
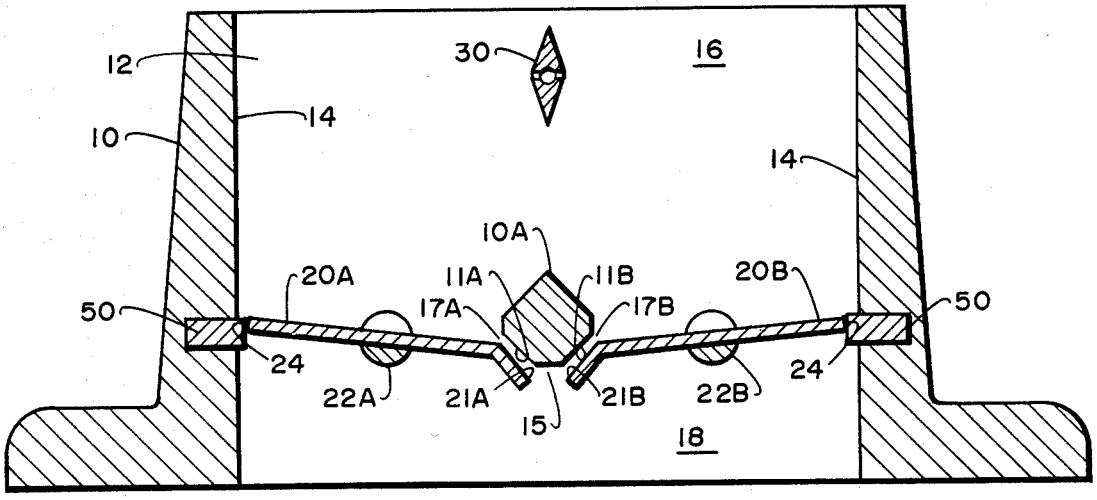
FIG. 28 is a cross sectional view of one embodiment of the present invention wherein the channel exit stream convergence is at right angles.

FIG. 28 illustrates an embodiment of the invention wherein stamped throttle blades are formed with an angled portion for locating surfaces 21A and 21B, to cooperate with angled surfaces 11A and 11B of extension 10A. This directs the channel exit streams to converge at a sharp angle for severe turbulence, yet the point of convergence is arranged to be further downstream in passageway 12, without the enhanced fuel separation common to embodiments previously described where convergence occurred further downstream. Additionally, the embodiment of FIG. 28 is provided with seals 50 which are adapted to slide in recesses in the throttle body to exert moderate pressure against edges 24 of the throttle blades for better sealing at small angles of throttle rotation.

Figure 29:
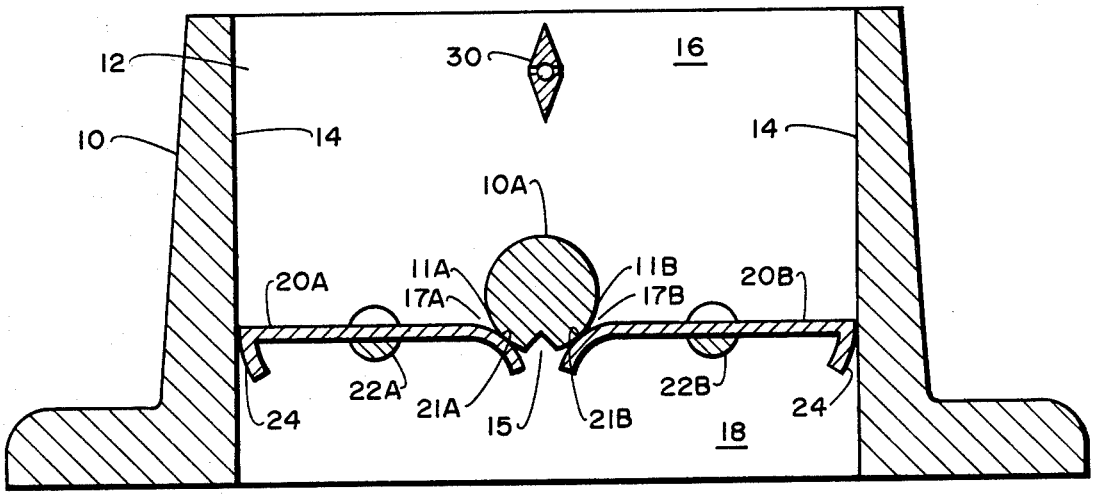
FIG. 29 is a cross sectional view of the intake passageway of one embodiment of the present invention wherein the channels have a first convergent, then divergent configuration.

FIG. 29 illustrates an embodiment of the invention wherein throttle blades are preferably stamped from metal sheet or strip stock, formed with special surfaces for enhanced flow control, and machined to final tolerances. In this embodiment, edges 24 are formed with a curved shape to cooperate more closely with walls 14 over a greater range of rotation of the throttle blades. The portion of the throttle blades having surfaces 21A and 21B are formed in a curved shape for cooperation with surfaces 11A and 11B, which are also curved. The resultant cooperation forms channels 17A and 17B which have a cross section that is first convergent, then divergent. This results in a flow through the channels where the mixture is accelerated to a high speed in the convergent part, then decelerated in the divergent part, where the divergent shape acts as a diffuser to recover the kinetic energy of the stream as static pressure. Shapes such as this can ensure high velocity mixture flow through the channels even when the intake vacuum falls to lower levels. This configuration is commonly found in carburetors wherein supersonic flow is used to finely atomize the fuel.

Figure 30:
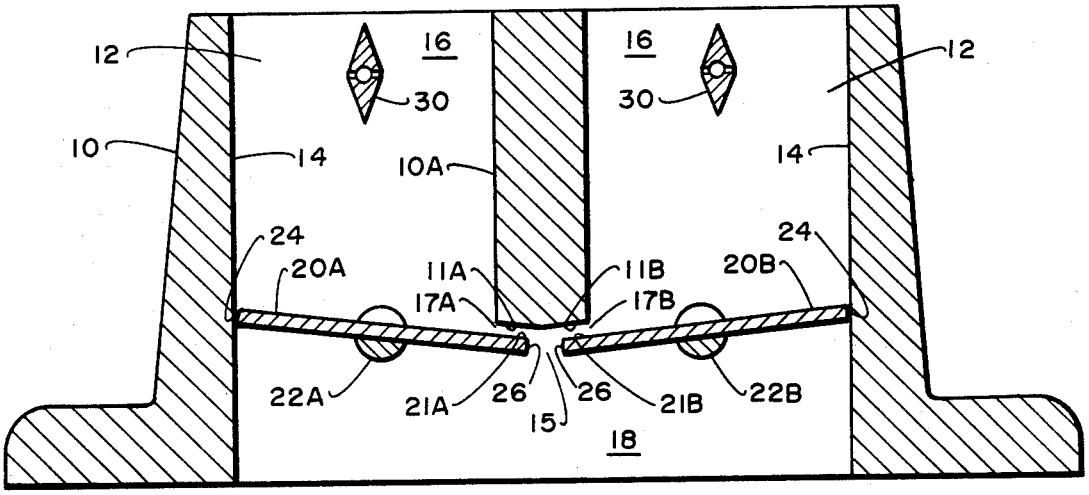
FIG. 30 is a cross sectional view of the intake passageway of one embodiment of the present invention wherein the transverse extension of the throttle body partitions the intake upstream of the throttle blades.

FIG. 30 illustrates an embodiment of the invention wherein the transverse extension 10A acts as a divider to separate the intake passageway 12 into sections. As shown, each section may be provided with a fuel outlet 30 to more evenly distribute fuel into the intake air.

Figure 31:
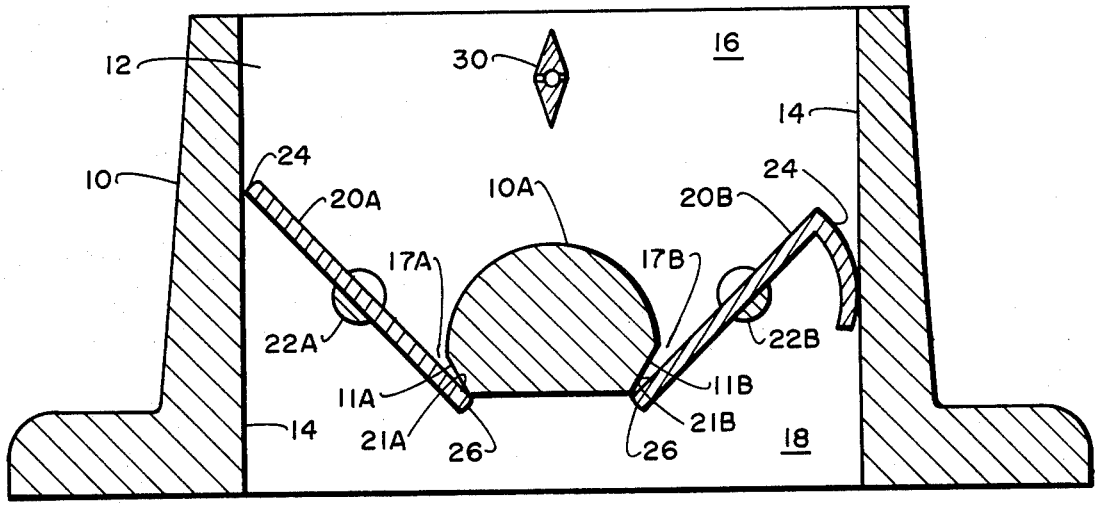
FIG. 31 is a cross sectional view of an embodiment of the present invention illustrating alternate configurations of the throttle blades and cooperations with the transverse extension.

FIG. 31 illustrates several alternate throttle blade structures or situations. Throttle blade 20A is situated at an angle to the axis of the intake passageway at closed throttle position. This allows the formation of an angled channel with reduced tendency of the liquid fuel to separate from the mixture at the entrance to channel 17A. However, the blade edge 24 will move more rapidly away from the wall 14, resulting in increased flow bypassing the channel 17A at lesser throttle openings. The advantages of throttle 20A can be enjoyed without the disadvantages by employing a configuration for the throttle such as that shown for the throttle blade 20B. Here, the edge 24 is formed as a curved portion of the blade for close cooperation with the wall 14 over a layer degree of rotation of the throttle.

Figure 32:
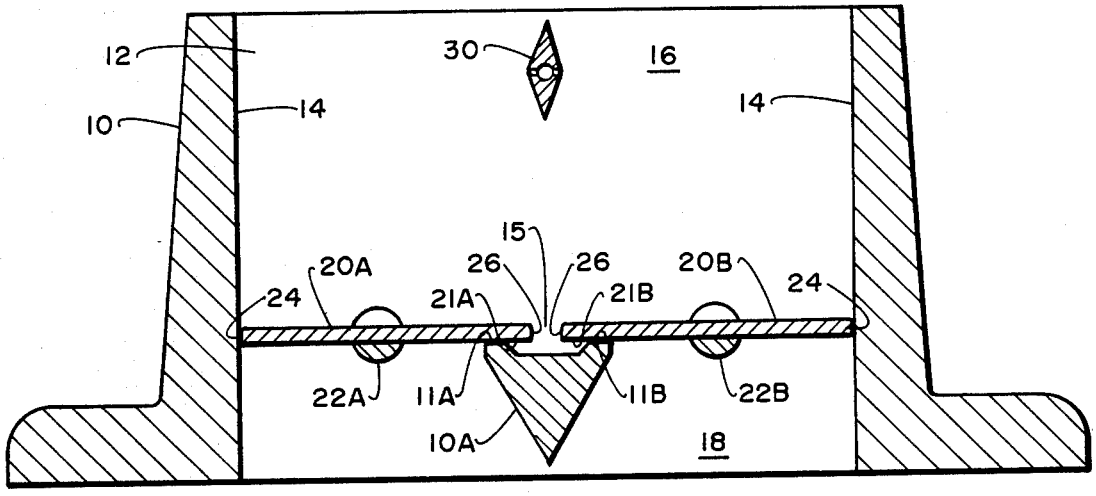
FIG. 32 is a cross sectional view of an embodiment of the present invention wherein the transverse extension is located downstream from the throttle blades.

FIG. 32 illustrates an embodiment of the invention having a variation wherein the transverse extension 10A is located downstream of the throttle blades. In this case, throttle shaft 22A rotates in a counterclockwise direction, while 22B rotates in a clockwise direction. This configuration can result in enhanced separation of liquid fuel onto the upstream surface of extension 10A. The channel exit streams flow toward the walls 14, and do not tend to converge.

Figure 33:
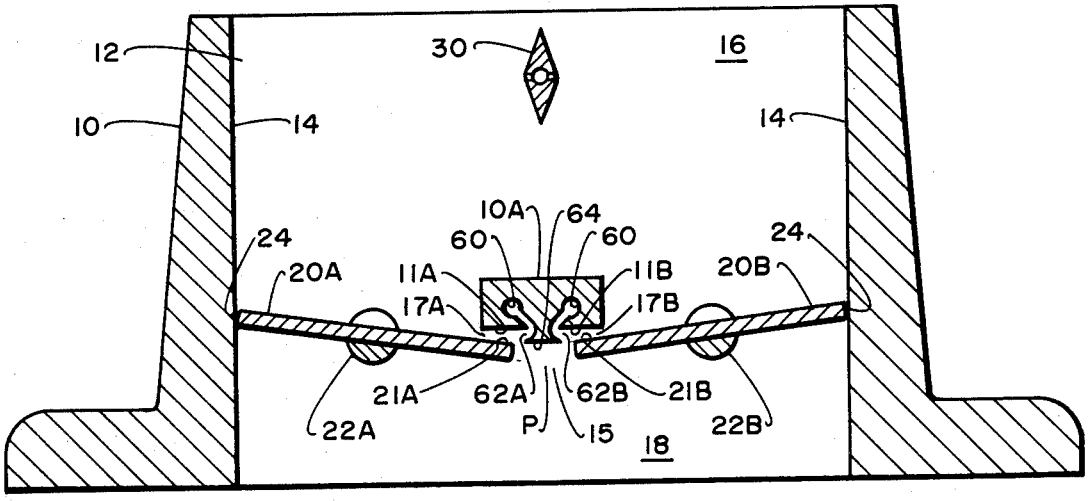
FIG. 33 is a cross sectional view of an embodiment of the present invention wherein the exit channel streams are directed toward passageways.

FIG. 33 illustrates an embodiment of the invention wherein the exit streams from the channels are directed into passageways at partial throttle openings; the passageways transport the fuel/air mixture to a heater, where heat is applied to the mixture to enhance fuel vaporization. The embodiment of FIG. 33 has a transverse extension 10A provided with passageways 60. Conduits 62A and 62B join the passageways 60 with the region 15 downstream of the throttle blades. The surfaces 11A and 11B lead into the conduits 62A and 62B respectively. A shaped portion 64 of the extension 10A directs the exit mixture streams from the channels into the conduits 62A and 62B respectively. The throttle blades 20A and 20B are shown in a partially open position. In operation, the high speed exit streams from the channels 17A and 17B are directed at the shaped openings to the conduits 62A and 62B formed by the shaped portion 64 of extension 10A. The momentum of the high speed mixture streams exiting the channels carries the mixture into the conduits 62A and 62B where the mixture is further transported to passageways 60. Passageways 60 transport the mixture to a heater or heat exchanger (not shown) where the mixture or the fuel in the mixture is heated to enhance liquid fuel vaporization. The mixture containing the vaporized fuel is reintroduced into the intake passageway 12 at a location (not shown) downstream from the throttles. At more open positions of the throttle, some of the mixture stream exiting the channels passes by the downstream surface of the shaped portion 64. The parts of the channel exit mixture streams which do not enter the conduits 62A and 62B converge and collide, in a manner as previously explained, at a location P downstream of the extension 10A. At much larger throttle openings the channel cross sections will be so large that only a much reduced part of the channel exit streams will be directed at the shaped entrances of the conduits 62A and 62B. Thus, the majority of the mixture exiting the channels will avoid the heater vaporization process and be mixed by the collision process which occurs at point P, downstream of the extension 10A. At low levels of intake vacuum, the streams exiting the channels may have insufficient momentum for a large amount of the fuel/air mixture to pass through the various conduit systems leading to the heater.

Figure 34:
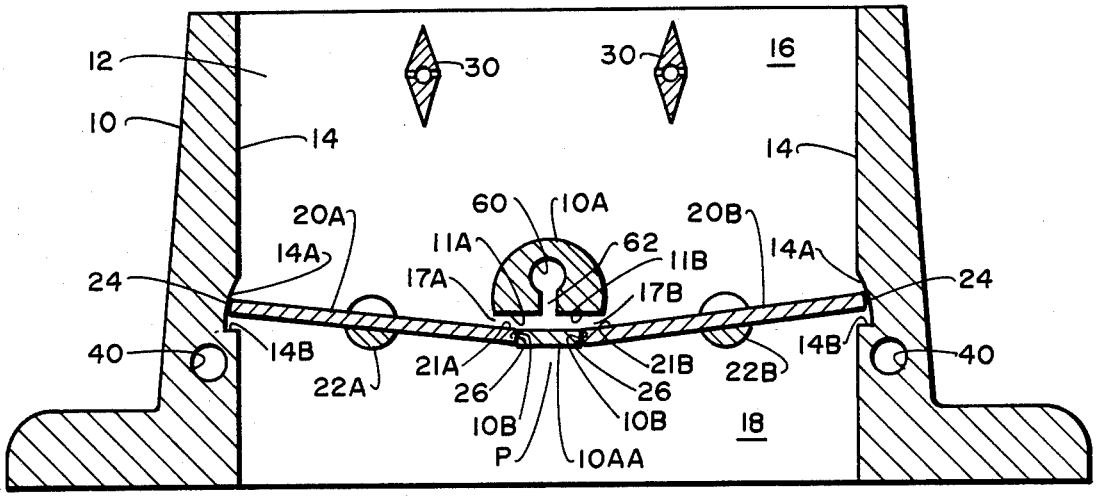
FIG. 34 is a cross sectional view of an embodiment of the present invention wherein the exit channel streams are directed toward passageways.

FIG. 34 illustrates an embodiment of the invention similar to the embodiment of FIG. 33, wherein the exit streams of fuel/air mixture from the channels enter a passageway in the transverse extension, whereby the mixture is transported to a heater for vaporization. In FIG. 34, shown with the throttle blades in the partially open position, the transverse extension of the throttle body 10A has conduits 62A and 62B leading to passageway 60. The part of extension 10A which is labeled 10AA is configured such that its edges 10B cooperate closely with the edges 26 of the throttle blades when the throttles are in the partially open position to essentially prevent the mixture exiting the channels from directly flowing to the passageway 12 immediately downstream from extension 10A. Rather, the mixture is forced by the close cooperation of surfaces 10B and edges 26 to flow into conduits 62A and 62B. The mixture subsequently flows through passageway 60 to be transported to a heater or heat exchanger (not shown), where the fuel is heated and vaporized. The mixture then re-enters the intake passageway 12 at a location downstream of the throttles (not shown). Another advantageous feature of the embodiment of FIG. 34 are the curved areas 14A of the walls 14. The contour illustrated here allows the edges 24 of the throttle blades to maintain close cooperation with the walls 14A over an extended range of rotation of the throttles to preclude substantial airflow. Additionally, the ledges 14B serve as a rest for the throttle blades to aid in sealing this region when the throttles are in the fully closed position. At partial throttle openings, any mixture leaking past the cooperation of surfaces 14A and edges 24 is likely to impinge on the ledges at 14B, possibly resulting in some liquid fuel separation. Passageways 40 provide heat to enhance vaporization of any fuel separating onto the surfaces 14B.

When the throttles rotate more open such that the throttle edges 26 move past the extremities of surfaces 10B, the channel exit streams flow along the downstream surface of 10AA and collide at location P, and subsequently this embodiment functions in a manner identical to that described in reference to the operation of the embodiment of FIG. 33.

Figure 35:
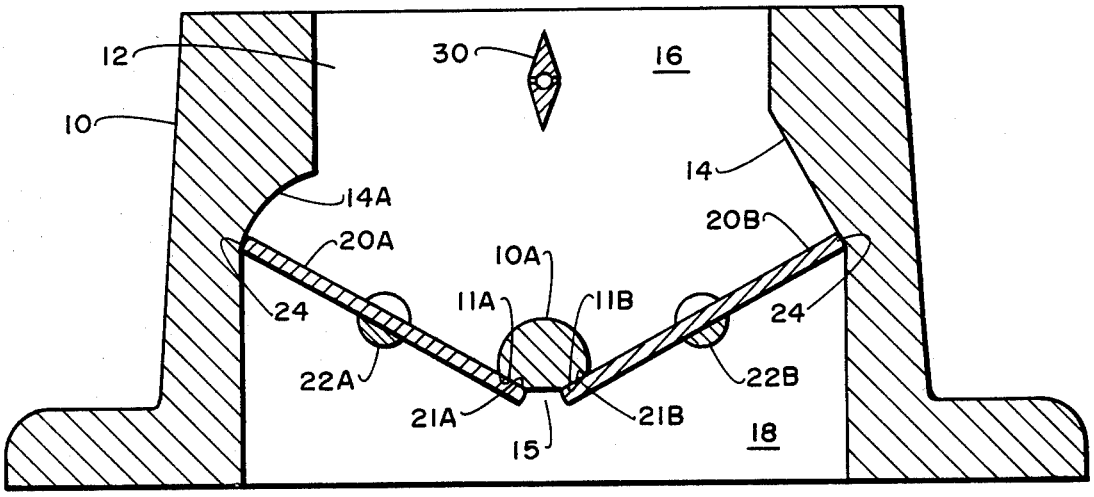
FIG. 35 is a cross sectional view of an embodiment of the present invention wherein two throttle blades are disposed in an angled relationship in the intake passageway.

FIG. 35 illustrates an embodiment of the present invention wherein the walls 14 of the intake passageway 12 are not straight, and the throttle blades 20A and 20B are angled with respect to one another at the fully closed position. The edge 24 of blade 20A is shown cooperating with a portion 14A of the wall 14 that is curved, the curved part having a radius slightly greater than the distance to the axis of rotation of blade 20A. This configuration precludes flow of mixture past the cooperation of surfaces 14A and 24 over a greater range of throttle rotational positions. The edge 24 of blade 20B is shown cooperating with a portion of the wall 14 that is angled with respect to the major axis of the passageway 12. Note that the edge 24 of blade 20B moves essentially parallel to the cooperating region of wall 14 for the initial several degrees of opening throttle rotation.

In the various specific embodiments of the invention described in detail herein, it will be noted that the edges 24 of the throttle blades are in close proximity with the walls 14 of the intake passageway when the throttle blades are in the closed or idle position. Then, for the first several degrees of opening rotational movement of the throttles, the edges 24 are moving in a direction essentially parallel or nearly parallel to the walls 14 such that the rate of opening of the space between edges 24 and walls 14 is initially small. The preferred condition for this, in the absence of any precluding special configurations or shapes for the edges 24 or cooperating regions of walls 14, is that the plane of a throttle blade is essentially perpendicular to the plane of the surface of wall 14 at the location of cooperation with the corresponding edge 24 of the throttle blade at closed or idle throttle positions. In view of this, it can be seen that it is not necessary to configure the present invention only with straight walls parallel to the major axis of passageway 12, as illustrated in the majority of the Figures. Rather, any desired contour for the surfaces of the walls 14 can be advantageously employed, where the conditions for blade edge to wall cooperation are preferably met as described immediately above. Nevertheless, the contour of the walls should be such that effective closure of the passageway 12 can be achieved at closed or idle throttle positions. For example, the walls 14 could be straight but diverging in the region of the throttles, and the throttle blades angled with respect to one another such that the above conditions of cooperation are met. Curved walls could also by employed under similar conditions. Examples of some of these conditions are illustrated in the previously described FIG. 35.

It has become apparent from the foregoing descriptions that the novelty of the present invention resides in the novel channels and their ability to open quickly to flow fuel and air mixture, achieving efficient atomization and mixing of the fuel and air. In order to more definitively describe and relate to these channels, some terms and concepts relating to the channels will now be defined.

In a carburetor for an internal combustion engine, the function of the throttle is to modulate the flow of fuel and air from upstream of the throttle to downstream from the throttle. In the present invention this is achieved at the more closed positions of the throttle by a cooperation of a surface of the throttle with a surface of the air inlet to form a channel; the flow through the channel serving to regulate the overall flow through the air inlet passageway. The flow through the channel, in turn, is governed by the effective cross-sectional width of the channel. Following the flow of fuel and air mixture through the channel, especially in reference to FIGS. 1 through 5, it can be seen that mixture flows through the air inlet upstream of the throttle, and then increases in speed as it enters the cooperation region of the channel. The flowing mixture then flows as a stream through the channel. The stream of mixture then separates away from a surface of the channel such that the stream is no longer confined by the channel surfaces. Total flow through the channel is essentially regulated by the most narrow part of the channel. This will also be the region of highest speed of the mixture flow.

The nature of the channel and its flow can be clearly understood by referring to the flow axis of the channel. The flow axis is a line that describes the average direction and speed of the mass of air flowing through any cross-section of the channel. The characteristics of the channel can be described with reference to the flow axis of the flow stream created by the channel.

The point of maximum speed occurs on the flow axis where the channel has its most narrow cross-section, as seen perpendicular to the flow axis. The channel has a channel exit located on the flow axis at the point where the channel flow stream becomes unconfined by the cooperating surfaces which form the channel. The condition of unconfined occurs when the flow stream separates away from either the throttle surface or the air inlet passageway. The channel exit is then a point on the flow axis where a line at a right angle to the flow axis intersects the location of flow stream separation that is most upstream in the channel. The channel acts to cause the mixture flow from the air inlet to increase in speed upon entering the channel. Therefore, the channel has an entrance that is the most upstream point on the flow axis where the speed has increased to one-half of the speed of the point of maximum speed. It can then be seen that the point of maximum speed will occur on the flow axis between the channel entrance and the channel exit. It might possibly be nearly coincident with the channel exit for channel configurations that have a converging cross-section, such as those shown in FIGS. 8, 24, and 31.

In order for the channel to generate a coherent flow stream, it must have a substantial length and, more specifically, a minimum ratio of length to width. The channel width is the shortest distance between the cooperating surfaces as viewed in a cross-section perpendicular to the axis of rotation of the throttle. Accordingly, the channel length must be at least equal to the channel width.

Since the channels of the present invention are formed as a result of a positional relationship between the throttle and the throttle body, the formation of the channels must be described in terms of the positional relationship of the throttle and throttle body. Therefore, the axis of rotation of the throttle is termed the throttle axis. The throttle rotates about the throttle axis to increase or decrease flow through the channels and to modulate flow through the air inlet passageway. The amount of rotation of the throttle axis from the most closed position to the position of maximum opening is termed the angle of total displacement.

Since it is the scope of the invention to restrict the inlet flow by forming channels at partial throttle opening, the channels are considered to be formed in the range of throttle positions that is from the most closed position to one-half the angle of total displacement.

There is defined a throttle plane that is associated with each channel and is a plane formed by the line of the throttle axis and the point on the air inlet passageway surface which is closest to the throttle axis and closest to the location of minimum separation of the throttle and throttle body in the region of the channel forming surfaces when the throttle is in its most closed position. That is to say that if there is more than one point on the throttle body in the region of the channel forming surfaces that is a distance that is the closest to the throttle axis, then the one closest to the location of minimum separation of the surfaces shall be used in determining the throttle plane. The throttle plane is determined with the throttle valve in its most closed position, and the throttle plane remains fixed in position with respect to the throttle valve, rotating with the throttle.

Additionally, the position of the throttle plane when the throttle is at its position of minimum opening is termed the zero position of the throttle plane. The zero position is defined by the throttle plane, but is fixed with respect ot the throttle body. Thus, the throttle plane is fixed to and moves with the throttle, but the zero position of the throttle plane is fixed with respect to the throttle body but considered to always exist irrespective of the actual throttle position.

It is one characteristic of the channels that they open quickly for small opening movements of the throttle. The opening of a channel is determined by the opening of the most restricted part, which as previously described is the region of the point of maximum speed. This characteristic of the channels is realized when the direction of the velocity vector of the channel axis at the point of maximum speed is nonperpendicular to the throttle plane. The direction of the velocity vector of the channel axis at the point of maximum speed is simultaneously nonperpendicular to the zero position of the throttle plane. By nonperpendicular, it is meant that the included angle between the throttle plane and the direction of the velocity vector is less than 75 degrees. It has been shown that an included angle of 75 degrees gives satisfactory performance, but there are configurations of the invention where an included angle of 45 degrees or less gives optimum performance. Thus, although there are many possible configurations for channel shapes according to the present invention, including straight, converging, converging-diverging venturi, curved, and even compound curved, the direction of the velocity vector describing the point of maximum speed will be nonperpendicular to the throttle plane.

In many configurations of the invention, a channel exit stream is employed to advantage for atomizing fuel and mixing the fuel and air. An exit stream is defined as a stream of mixture which has immediately exited a channel by flowing past the channel exit, and where the stream has separated from both the throttle surface and the inlet passageway surface. Very distinct advantages can be realized from the confluence of two exit streams in an embodiment of the invention having two channels.

It is also noteworthy that a single throttle could cooperate in two locations with the air inlet passageway to form two channels. In such a case, there would be a throttle plane associated with each channel, and therefore two distinct throttle planes for the single throttle.

Although the preferred embodiments of the invention described herein utilize an intake passageway of rectilinear cross section, it is fully appreciated and anticipated that intake passageways of many other configurations besides rectilinear, including round, may be employed to advantage within the scope of the present invention.

It is further appreciated and anticipated that there are many other ways of practicing the present invention besides the specific ways described in detail herein. For instance, a single carburetor throttle body assembly could be provided with a plurality of intake passageways, divided or undivided, wherein each intake passageway is equipped with a throttle blade configuration as described herein. Also, there could be provided in the intake passageway a number of throttle blades other than two, wherein there is throttle blade cooperation with the throttle body for forming channels. Also, gears have been indicated as the means for effecting coordinated rotation of the throttles in embodiments employing a plurality of throttle blades in the intake passageway. It should be understood that there are many other linkages that could be advantageously used to operate a plurality of throttle blades in the present invention. Therefore, the foregoing Figures and description are intended to be illustrative only, and not limiting; the scope of the invention being as defined in the claims appended hereto.

What is claimed is:

1. An apparatus for fuel and air mixing and flow modulation for supplying fuel and air to an internal combustion engine, said apparatus comprising:

throttle body means having an air inlet passageway therein;

a butterfly-type throttle valve means rotatably disposed in said air inlet passageway for regulating a fuel and air mixture flowing therethrough;

said throttle valve means having a throttle axis;

said throttle valve being adapted to rotate about said throttle axis from a position of minimum opening to a position of maximum opening to define an angle of total displacement;

a surface of said throttle valve means closely cooperating with a surface of said air inlet passageway to form between them a channel means for flowing said fuel and air mixture from said air inlet passageway upstream of said throttle valve means to said air inlet passageway downstream from said throttle valve means;

said channel means forming a channel flow stream of said fuel and air mixture flowing in said channel;

a throttle plane fixed with respect to said throttle valve;

said channel flow stream having a channel flow axis;

said channel flow axis having a point of maximum speed where the channel flow stream has a maximum speed along said channel flow axis;

said channel having a channel exit;

said channel having a channel entrance located at a point on said channel flow axis, upstream from said point of maximum speed, where channel flow stream speed is one-half of the maximum speed;

said channel having a channel length equal to a length along the channel flow axis from the channel exit to the channel entrance;

said channel having a channel width equal to the smallest distance between said surface of said throttle valve means and said surface of said air inlet passageway;

said channel length being at least equal to said channel width;

said channel flow axis having a direction at the point of maximum speed that is nonperpendicular to said throttle plane;

said throttle plane having a zero position;

said channel flow axis having a direction at the point of maximum speed that is nonperpendicular to said throttle plane at said zero position;

said channel flow stream separating from said surface of said throttle valve;

said surface of said throttle valve means cooperating with said surface of said air inlet passageway to form said channel when said throttle is in a position that is in the range of from said position of minimum opening to one-half said angle of total displacement.

* * * * *